US010718507B2

(12) United States Patent
Potucek et al.

(10) Patent No.: US 10,718,507 B2
(45) Date of Patent: Jul. 21, 2020

(54) UNDERWATER LIGHT HAVING A SEALED POLYMER HOUSING AND METHOD OF MANUFACTURE THEREFOR

(71) Applicant: Hayward Industries, Inc., Berkeley Heights, NJ (US)

(72) Inventors: Kevin L. Potucek, Far Hills, NJ (US); James Carter, Warren, RI (US); James Murdock, Wakefield, RI (US); Joe Diorio, North Providence, RI (US); Steven Mitchell, Chepachet, RI (US)

(73) Assignee: Hayard Industries, Inc., Berkeley Heights, NJ (US)

( * ) Notice: Subject to any disclaimer, the term of this patent is extended or adjusted under 35 U.S.C. 154(b) by 0 days.

(21) Appl. No.: 13/786,739

(22) Filed: Mar. 6, 2013

(65) Prior Publication Data

US 2013/0182442 A1 Jul. 18, 2013

Related U.S. Application Data

(62) Division of application No. 12/769,038, filed on Apr. 28, 2010.

(51) Int. Cl.
*F21V 31/00* (2006.01)
*F21V 29/74* (2015.01)
(Continued)

(52) U.S. Cl.
CPC ..... *F21V 31/005* (2013.01); *F21S 8/00* (2013.01); *F21V 15/01* (2013.01); *F21V 29/507* (2015.01);
(Continued)

(58) Field of Classification Search
CPC ..... F21S 8/00; F21V 29/002; F21V 29/004; F21W 2131/401; F21Y 2101/02
(Continued)

(56) References Cited

U.S. PATENT DOCUMENTS 1,874,513 A 8/1932 Hall
1,991,775 A 2/1935 Spencer
(Continued)

FOREIGN PATENT DOCUMENTS

CN 2705700 6/2005
CN 1664439 9/2005
(Continued)

OTHER PUBLICATIONS

IntelliBrite ™ Underwater Color-Changing Lights (2007) (4 pages).
(Continued)

*Primary Examiner* — Tsion Tumebo
(74) *Attorney, Agent, or Firm* — McCarter & English, LLP

(57) ABSTRACT

An underwater light having a sealed polymer housing includes a rear housing component formed at least in part from a thermally conductive and electrically insulative material, an electronic assembly having at least one light-emitting element mounted thereto, the electronic assembly in thermal communication with the rear housing component, and a lens mounted to the rear housing component and forming a watertight seal therebetween, the lens and the rear housing component enclosing the electronic assembly. At least a portion of the rear housing component conducts heat away from the electronic assembly to cool the electronic assembly.

25 Claims, 16 Drawing Sheets

(51) Int. Cl.

| | |
|---|---|
| ***F21V 29/507*** | (2015.01) |
| ***F21V 15/01*** | (2006.01) |
| ***F21S 8/00*** | (2006.01) |
| ***F21V 29/70*** | (2015.01) |
| ***F21W 131/401*** | (2006.01) |
| ***F21Y 115/10*** | (2016.01) |
| ***F21V 29/58*** | (2015.01) |
| ***F21V 29/87*** | (2015.01) |

(52) U.S. Cl.
CPC ..... *F21V 29/59* (2015.01); *F21V 29/70* (2015.01); *F21V 29/74* (2015.01); *F21V 29/87* (2015.01); *F21W 2131/401* (2013.01); *F21Y 2115/10* (2016.08)

(58) Field of Classification Search
USPC ..... 362/249.02, 294, 267, 373
See application file for complete search history.

(56) References Cited

U.S. PATENT DOCUMENTS 2,057,186 A 10/1936 Freeberg
2,323,793 A 7/1943 Clark
2,355,607 A 8/1944 Shepherd
2,881,409 A 4/1959 Cook
2,903,674 A 9/1959 Schwab
3,020,522 A 2/1962 Lesher
3,114,127 A 12/1963 Ramsey
3,213,377 A 10/1965 Neale
3,255,433 A 6/1966 Lesher
3,257,641 A 6/1966 Campana et al.
3,271,734 A 9/1966 Cabe et al.
3,435,213 A 3/1969 Colbow et al.
3,594,720 A 7/1971 Cane
3,804,049 A 4/1974 Greer
4,053,758 A 10/1977 Shaw
4,054,792 A 10/1977 Brudy
4,135,144 A 1/1979 Elmasian
4,298,868 A 11/1981 Spurgeon
4,392,187 A 7/1983 Bornhorst
4,636,036 A 1/1987 Pasquali
4,729,076 A 3/1988 Masami et al.
4,814,800 A 3/1989 Lavinsky et al.
4,890,208 A 12/1989 Izenour
4,974,133 A 11/1990 Fujiki
5,045,983 A 9/1991 Shields
5,220,464 A 6/1993 Lin
5,256,948 A 10/1993 Boldin et al.
5,295,054 A * 3/1994 Baader ..... B60Q 1/2615 362/267
5,528,474 A 6/1996 Roney et al.
5,632,551 A * 5/1997 Roney et al. ..... 362/485
5,649,242 A 7/1997 O'Brien et al.
5,785,418 A * 7/1998 Hochstein ..... B60Q 1/2696 362/294
5,842,771 A * 12/1998 Thrasher et al. ..... 362/101
5,893,626 A 4/1999 Poling
6,002,216 A 12/1999 Mateescu
6,016,038 A 1/2000 Mueller et al.
6,045,240 A 4/2000 Hochstein
6,081,191 A 6/2000 Green et al.
RE36,790 E 7/2000 Jincks et al.
6,090,484 A * 7/2000 Bergerson ..... 428/355 EN
6,100,791 A 8/2000 Bader et al.
6,152,577 A 11/2000 Rizkin et al.
6,166,496 A 12/2000 Lys et al.
6,175,354 B1 1/2001 Blissett et al.
6,184,628 B1 2/2001 Ruthenberg
6,196,471 B1 3/2001 Ruthenberg
6,211,626 B1 4/2001 Lys et al.
6,241,361 B1 * 6/2001 Thrasher et al. ..... 362/101
6,241,362 B1 6/2001 Morrison
6,292,901 B1 9/2001 Lys et al.
6,357,889 B1 3/2002 Duggal et al.
6,367,541 B2 4/2002 McCullough
6,379,025 B1 4/2002 Mateescu et al.
6,435,691 B1 8/2002 Macey et al.
6,441,943 B1 8/2002 Roberts et al.
6,459,919 B1 10/2002 Lys et al.
6,528,954 B1 3/2003 Lys et al.
6,548,967 B1 4/2003 Dowling et al.
6,554,454 B1 4/2003 Kitano et al.
6,585,399 B2 7/2003 Kreutzer et al.
6,608,453 B2 8/2003 Morgan et al.
6,616,291 B1 9/2003 Love et al.
6,622,053 B1 9/2003 Hewlett et al.
6,624,597 B2 9/2003 Dowling et al.
6,717,376 B2 4/2004 Lys et al.
6,720,745 B2 4/2004 Lys et al.
6,774,584 B2 8/2004 Lys et al.
6,777,891 B2 8/2004 Lys et al.
6,781,329 B2 8/2004 Mueller et al.
6,801,003 B2 10/2004 Schanberger et al.
6,811,286 B2 11/2004 Mateescu et al.
6,831,679 B1 12/2004 Olsson et al.
6,869,204 B2 3/2005 Morgan et al.
6,883,929 B2 4/2005 Dowling
6,886,625 B1 5/2005 Sagal et al.
6,888,322 B2 5/2005 Dowling et al.
6,896,045 B2 5/2005 Panek
6,897,624 B2 5/2005 Lys et al.
6,936,978 B2 8/2005 Morgan et al.
6,965,205 B2 11/2005 Piepgras et al.
6,967,448 B2 11/2005 Morgan et al.
6,969,954 B2 11/2005 Lys
6,971,760 B2 12/2005 Archer et al.
6,975,079 B2 12/2005 Lys et al.
6,981,805 B2 1/2006 Miller et al.
7,023,147 B2 4/2006 Colby et al.
7,031,920 B2 4/2006 Dowling et al.
7,038,398 B1 5/2006 Lys et al.
7,038,399 B2 5/2006 Lys et al.
7,055,988 B2 6/2006 Mateescu et al.
7,064,498 B2 6/2006 Dowling et al.
7,097,329 B2 8/2006 Mateescu et al.
7,113,541 B1 9/2006 Lys et al.
7,125,146 B2 10/2006 Willis et al.
7,128,440 B2 10/2006 Mateescu et al.
7,132,635 B2 11/2006 Dowling
7,132,785 B2 11/2006 Ducharme
7,135,824 B2 11/2006 Lys et al.
7,139,617 B1 11/2006 Morgan et al.
7,161,311 B2 1/2007 Mueller et al.
7,161,556 B2 1/2007 Morgan et al.
7,178,941 B2 2/2007 Roberge et al.
7,180,252 B2 2/2007 Lys et al.
7,186,003 B2 3/2007 Dowling et al.
7,202,613 B2 4/2007 Morgan et al.
7,204,602 B2 4/2007 Archer
7,204,622 B2 4/2007 Dowling et al.
7,228,190 B2 6/2007 Dowling et al.
7,231,060 B2 6/2007 Dowling et al.
7,233,115 B2 6/2007 Lys
7,233,831 B2 6/2007 Blackwell
7,242,152 B2 7/2007 Dowling et al.
7,248,239 B2 7/2007 Dowling et al.
7,253,566 B2 8/2007 Lys et al.
7,255,457 B2 8/2007 Ducharme et al.
7,256,554 B2 8/2007 Lys et al.
7,278,762 B2 10/2007 Schottland et al.
7,300,192 B2 11/2007 Mueller et al.
7,303,300 B2 12/2007 Dowling et al.
7,303,301 B2 12/2007 Koren et al.
7,344,279 B2 3/2008 Mueller et al.
7,352,339 B2 4/2008 Morgan et al.
7,353,071 B2 4/2008 Blackwell et al.
7,357,525 B2 4/2008 Doyle
7,358,679 B2 4/2008 Lys et al.
7,358,706 B2 4/2008 Lys
7,358,929 B2 4/2008 Mueller et al.
7,364,488 B2 4/2008 Mueller et al.
7,396,139 B2 7/2008 Savage
7,410,268 B2 8/2008 Koren et al.

(56) References Cited

U.S. PATENT DOCUMENTS

| | | | | |
|---|---|---|---|---|
| 7,482,764 | B2 | 1/2009 | Morgan et al. | |
| 7,488,084 | B2 | 2/2009 | Potucek et al. | |
| 7,497,595 | B2 | 3/2009 | Mateescu et al. | |
| 7,514,884 | B2 | 4/2009 | Potucek et al. | |
| 7,520,628 | B1 | 4/2009 | Sloan et al. | |
| 7,524,086 | B1 | 4/2009 | Saieva | |
| 7,553,040 | B2 | 6/2009 | Boothe et al. | |
| 7,591,564 | B1 | 9/2009 | Ball et al. | |
| 7,628,512 | B2 | 12/2009 | Netzel, Sr. et al. | |
| 7,705,240 | B2 | 4/2010 | Armstrong et al. | |
| 7,722,216 | B2 | 5/2010 | Amor et al. | |
| 7,914,162 | B1 * | 3/2011 | Huang | B60L 1/14 219/220 |
| 2002/0043938 | A1 | 4/2002 | Lys | |
| 2002/0074559 | A1 | 6/2002 | Dowling et al. | |
| 2002/0113555 | A1 | 8/2002 | Lys et al. | |
| 2002/0130627 | A1 | 9/2002 | Morgan et al. | |
| 2002/0149933 | A1 | 10/2002 | Archer et al. | |
| 2002/0152045 | A1 | 10/2002 | Dowling et al. | |
| 2002/0163316 | A1 | 11/2002 | Lys et al. | |
| 2002/0171377 | A1 | 11/2002 | Mueller et al. | |
| 2002/0176259 | A1 | 11/2002 | Ducharme et al. | |
| 2003/0048632 | A1 | 3/2003 | Archer | |
| 2003/0057884 | A1 | 3/2003 | Dowling et al. | |
| 2003/0133292 | A1 | 7/2003 | Mueller et al. | |
| 2004/0047145 | A1 | 3/2004 | Koren | |
| 2004/0052076 | A1 | 3/2004 | Mueller et al. | |
| 2004/0085754 | A1 | 5/2004 | Koren et al. | |
| 2004/0105261 | A1 | 6/2004 | Ducharme et al. | |
| 2004/0141321 | A1 | 7/2004 | Dowling et al. | |
| 2004/0184284 | A1 | 9/2004 | Buelow et al. | |
| 2004/0208008 | A1 | 10/2004 | Mateescu et al. | |
| 2004/0223320 | A1 | 11/2004 | Archer et al. | |
| 2004/0252520 | A1 | 12/2004 | Martineau et al. | |
| 2005/0040774 | A1 | 2/2005 | Mueller et al. | |
| 2005/0041161 | A1 | 2/2005 | Dowling et al. | |
| 2005/0047134 | A1 | 3/2005 | Mueller et al. | |
| 2005/0047772 | A1 | 3/2005 | Hayami et al. | |
| 2005/0088119 | A1 | 4/2005 | Potucek et al. | |
| 2005/0088434 | A1 | 4/2005 | Potucek | |
| 2005/0099824 | A1 | 5/2005 | Dowling et al. | |
| 2005/0116665 | A1 | 6/2005 | Colby et al. | |
| 2005/0128751 | A1 | 6/2005 | Roberge et al. | |
| 2005/0168970 | A1 | 8/2005 | Mateescu et al. | |
| 2005/0174473 | A1 | 8/2005 | Morgan et al. | |
| 2005/0213352 | A1 | 9/2005 | Lys | |
| 2005/0213353 | A1 | 9/2005 | Lys | |
| 2005/0218870 | A1 | 10/2005 | Lys | |
| 2005/0248299 | A1 | 11/2005 | Chemel et al. | |
| 2005/0276044 | A1 | 12/2005 | Mateescu et al. | |
| 2006/0002104 | A1 * | 1/2006 | Willis | F21V 23/005 362/101 |
| 2006/0012987 | A9 | 1/2006 | Ducharme et al. | |
| 2006/0022214 | A1 | 2/2006 | Morgan et al. | |
| 2006/0023454 | A1 | 2/2006 | Koren | |
| 2006/0076908 | A1 | 4/2006 | Morgan et al. | |
| 2006/0087850 | A1 * | 4/2006 | Thompson et al. | 362/362 |
| 2006/0092636 | A1 | 5/2006 | Potucek et al. | |
| 2006/0198128 | A1 | 9/2006 | Piepgras et al. | |
| 2006/0215408 | A1 * | 9/2006 | Lee | 362/294 |
| 2006/0238130 | A1 | 10/2006 | Hosoya | |
| 2006/0291213 | A1 | 12/2006 | Mateescu et al. | |
| 2007/0096134 | A1 | 5/2007 | Kim et al. | |
| 2007/0097667 | A1 | 5/2007 | Armstrong et al. | |
| 2007/0097675 | A1 | 5/2007 | Koren et al. | |
| 2007/0139913 | A1 * | 6/2007 | Savage | 362/101 |
| 2007/0159833 | A1 | 7/2007 | Netzel, Sr. et al. | |
| 2007/0230194 | A1 * | 10/2007 | Vilarrasa | 362/373 |
| 2007/0263378 | A1 | 11/2007 | Koren | |
| 2008/0112157 | A1 | 5/2008 | Boothe et al. | |
| 2008/0165547 | A1 | 7/2008 | Amor et al. | |
| 2008/0197788 | A1 | 8/2008 | Conover et al. | |
| 2008/0297068 | A1 | 12/2008 | Koren et al. | |
| 2009/0013570 | A1 | 1/2009 | Grajcar | |
| 2009/0109617 | A1 | 4/2009 | Grajcar | |
| 2009/0180281 | A1 * | 7/2009 | Ahland et al. | 362/234 |
| 2009/0180290 | A1 | 7/2009 | Grajcar | |
| 2009/0185350 | A1 | 7/2009 | Grajcar | |
| 2009/0185373 | A1 | 7/2009 | Grajcar | |
| 2009/0204239 | A1 | 8/2009 | Netzel, Sr. et al. | |
| 2010/0118511 | A1 | 5/2010 | Wegat | |
| 2010/0157599 | A1 | 6/2010 | Carter et al. | |
| 2011/0096548 | A1 * | 4/2011 | Pickard | 362/294 |
| 2011/0267834 | A1 | 11/2011 | Potucek et al. | |

FOREIGN PATENT DOCUMENTS

| | | | |
|---|---|---|---|
| CN | 101010234 | | 8/2007 |
| DE | 10321992 | A1 | 3/2005 |
| DE | 102008056498 | A1 | 5/2010 |
| EP | 1016062 | | 8/2002 |
| GB | 2239306 | | 6/1991 |
| WO | WO 99/31560 | | 6/1999 |
| WO | WO 00/01067 | | 1/2000 |
| WO | WO 01/05195 | | 1/2001 |
| WO | WO 01/24584 | | 4/2001 |
| WO | WO 01/36864 | | 5/2001 |
| WO | WO 01/82657 | | 11/2001 |
| WO | WO 01/99475 | | 12/2001 |
| WO | WO 02/10847 | | 2/2002 |
| WO | WO 02/11497 | | 2/2002 |
| WO | WO 02/12127 | | 2/2002 |
| WO | WO 02/13490 | | 2/2002 |
| WO | WO 02/18913 | | 3/2002 |
| WO | WO 02/25842 | | 3/2002 |
| WO | WO 02/040921 | | 5/2002 |
| WO | WO 02/045467 | | 6/2002 |
| WO | WO 02/061330 | | 8/2002 |
| WO | WO 02/069306 | | 9/2002 |
| WO | WO 02/091805 | | 11/2002 |
| WO | WO 02/098182 | | 12/2002 |
| WO | WO 02/098183 | | 12/2002 |
| WO | WO 02/099780 | | 12/2002 |
| WO | WO 02/101702 | | 12/2002 |
| WO | WO 03/024269 | | 3/2003 |
| WO | WO 03/026358 | | 3/2003 |
| WO | WO 03/055273 | | 7/2003 |
| WO | WO 03/067934 | | 8/2003 |
| WO | WO 03/096761 | | 11/2003 |
| WO | WO 2004/021747 | | 3/2004 |
| WO | WO 2004/023850 | | 3/2004 |
| WO | WO 2004/032572 | | 4/2004 |
| WO | WO 2004/094896 | | 11/2004 |
| WO | WO 2004/100624 | | 11/2004 |
| WO | WO 2005/012997 | | 2/2005 |
| WO | WO 2005/060309 | | 6/2005 |
| WO | WO 2005/084339 | | 9/2005 |
| WO | WO 2005/089293 | | 9/2005 |
| WO | WO 2005/089309 | | 9/2005 |
| WO | WO 2006/023149 | | 3/2006 |
| WO | WO 2006/031753 | | 3/2006 |
| WO | WO 2006/031810 | | 3/2006 |
| WO | WO 2008/067402 | | 6/2008 |
| WO | 2010/032062 | A1 | 3/2010 |

OTHER PUBLICATIONS

Underwater ColorLogic™ LED Lighting Fixtures SP0525(S) Owner's Manual (2004) (12 pages).

Underwater ColorLogic™ LED Lighting Fixtures SP0523(S) Owner's Manual (2004) (12 pages).

U.S. Appl. No. 60/515,090 entitled "Color Changing Image with Backlighting and Combination Localized Gray-Scale and Color Image" filed Oct. 28, 2003, Inventors: Kevin Potucek and Kevin Murphy (13 pages).

U.S. Appl. No. 60/071,281 entitled "Digitally Controlled Light Emitting Diode Systems and Methods" filed Dec. 17, 1997, Inventors: George G. Mueller and Ihor A. Lys (24 pages).

U.S. Appl. No. 60/243,250 entitled "Illumination of Liquids" filed Oct. 25, 2000, Inventors: Frederick Morgan, Timothy Holmes, Chris Cantone, Ihor Lys and George Mueller (24 pages).

(56) References Cited

OTHER PUBLICATIONS

U.S. Appl. No. 60/297,828 entitled "Systems and Methods for Controlling Lighting Systems" filed Jun. 13, 2001, Inventors: George Mueller, Frederick Morgan, Ihor Lys and Kevin Dowling (13 pages).
U.S. Appl. No. 60/296,377 entitled "Systems and Methods for Controlling Lighting Systems" filed Jun. 6, 2001, Inventors: Mike Blackwell (11 pages).
U.S. Appl. No. 60/290,101 entitled "Systems and Methods for Synchronizing Illumination Systems" filed May 10, 2001, Inventors: Kevin Dowling and Eric K. Schanberger (27 pages).
U.S. Appl. No. 60/090,920 entitled "Method for Software Driven Generation of Multiple Simultaneous High Speed Pulse Width Modulated Signals" filed Jun. 26, 1998, Inventors: Ihor Lys (8 pages).
U.S. Appl. No. 60/078,861 entitled "Digital Lighting Systems" filed Mar. 20, 1998, Inventors: Ihor Lys (2 pages).
U.S. Appl. No. 60/079,285 entitled "Systems and Methods for Controlled Illumination" filed Mar. 25, 1998, Inventors: George G. Mueller and Ihor Lys (34 pages).
U.S. Appl. No. 60/068,792 entitled "Multi-Color Intelligent Lighting" filed Dec. 24, 1997, Inventors: George G. Mueller and Ihor Lys (2 pages).
U.S. Appl. No. 60/199,333 entitled "Autonomous Color Changing Accessory" filed Apr. 24, 2000, Inventors: Al Ducharme, Ihor Lys and Kevin Dowling (19 pages).
International Search Report of the International Searching Authority dated Jun. 12, 2008, issued in connection with International Patent Appl. No. PCT/US07/85793 (3 pages).
Written Opinion of the International Searching Authority dated Jun. 12, 2008, issued in connection with International Patent Appl. No. PCT/US07/85793 (5 pages).
Underwater ColorLogic™ LED Lighting Fixtures SP0524(S), SP0525(S), SP0527(S), SP0532(S), SP0533(S) and SP0535(S) Owner's Manual (2004) (12 pages).
CoolPoly® D5108 Thermally Conductive Polyphenylene Sulfide (PPS), Product Data Sheet dated Aug. 8, 2007 (2 pages).
American/Pentair Niche w/3/4 in. Side Hub, Concrete (78210400), printed from Internet website http://www.poolplaza.com/P-PEN-78210400-2282. html (Oct. 19, 2010) (1 page).
American/Pentair Niche w/1.0 in. Hub, Vinyl/Fbgls (10 Hole) (78232500), printed from Internet website http://www.poolplaza.com/P-PEN-78210400-2282. html (Oct. 19, 2010) (1 page).
Sta-Rite® Large Underwater Light Niche Owner's Manual (2004) (8 pages).
Product Specifications for Jandy ProNiche Pool and Spa Light Niches, printed from Internet website http://www.jandy.com/html/products/lights/proniche/specs.php (Oct. 19, 2010) (2 pages).
Jandy ProNiche~Pool & Spa Light Niches, product description (2007) (2 pages).
Jandy Installation Manual Jandy Housing for Wet Niche Fixtures (2007) (8 pages).
Pentair 620004 AmerLite Quick Niche, printed from Internet website http://www.aqua-man.com/row_num.asp?Ic=1892 (Oct. 19, 2010) (2 pages).
Pentair 79206700 AmerLite Large Plastic Niche, printed from Internet website http://www.aqua-man.com/row_num.asp?Ic=1895 (Oct. 19, 2010) (2 pages).
QuickNiche Vinyl Pool Lighting Niche by Pentair Water Pool and Spa, product description (2006) (2 pages).
Bond-Ply 100 - "Thermally Conductive, Fiberglass Reinfornced Pressure Sensitive Adhesive Tape," the Bergquist Company, http://www.bergquistcompany.com, publicly available prior to Dec. 24, 2008 (3 pages).
Aqua Logic Automation and Chlorination Operation Manual (2004) (40 pages).
Extended European Search Report and Search Opinion dated Aug. 11, 2011, in connection with European Patent Application No. EP11164216 (6 pages).
Final Office Action dated Aug. 20, 2014 from U.S. Appl. No. 12/769,038 (10 pages).
Office Action dated Dec. 3, 2013 from U.S. Appl. No. 12/769,038 (9 pages).
Final Office Action dated May 9, 2012 from U.S. Appl. No. 12/769,038 (10 pages).
Office Action dated Sep. 6, 2011 from U.S. Appl. No. 12/769,038 (9 pages).
Office Action dated Apr. 2, 2015, from pending U.S. Appl. No. 12/769,038 (15 pages).
Patent Examination Report dated May 13, 2015, issued in connection with Australian Patent Application No. 2011201916 (4 pages).
Patent Examination Report dated Mar. 18, 2014, issued in connection with Australian Patent Application No. 2011201916 (4 pages).
English Translation of the First Office Action dated Jul. 31, 2014, issued in connection with Chinese Patent Application No. 201110152483.3 (11 pages).
English Translation of the Second Office Action dated May 21, 2015, issued in connection with Chinese Patent Application No. 201110152483.3 (4 pages).
Office Action dated Dec. 30, 2015, issued in connection with U.S. Appl. No. 12/769,038 (13 pages).
Office Action dated Nov. 3, 2015, issued in connection with European Patent Application No. 11164216.1 (9 pages).
Patent Examination Report dated Jul. 19, 2016, issued in connection with Australian Patent Application No. 2015271887 (3 pages).
Office Action dated Nov. 17, 2016, issued in connection with U.S. Appl. No. 12/769,038 (13 pages).
Examination Report dated Feb. 20, 2017, issued by the Canadian Intellectual Property Office in connection with Canadian Patent Application No. 2,738,255 (7 pages).
Examiner's Answer to Appeal Brief dated Nov. 27, 2018, issued in connection with U.S. Appl. No. 12/769,038 (10 pages).
Office Action dated Aug. 25, 2017, issued in connection with U.S. Appl. No. 12/769,038 (15 pages).
Office Action (Restriction Requirement) dated May 9, 2011, issued in connection with U.S. Appl. No. 12/769,038 (9 pages).
Patent Examination Report dated Dec. 3, 2015, issued in connection with Australian Patent Application No. 2011201916 (4 pages).
Third Party Observations dated Apr. 11, 2015, submitted in connection with European Patent Application No. 11164216.1 (2 pages).
Office Action dated Nov. 18, 2016, issued in connection with European Patent Application No. 11164216.1 (6 pages).
Decision on Appeal dated Jan. 30, 2020, issued by the Patent Trial and Appeal Board in connection with U.S. Appl. No. 12/769,038 (14 pages).

* cited by examiner 118
104

106
100
110
110
102
114
114
116
112
108
114
110
114
106
118
104

UNDERWATER LIGHT HAVING A SEALED POLYMER HOUSING AND METHOD OF MANUFACTURE THEREFOR

RELATED APPLICATIONS

This application is a divisional application of, and claims priority to, U.S. patent application Ser. No. 12/769,038 filed Apr. 28, 2010, the entire disclosure of which is expressly incorporated herein by reference.

BACKGROUND

Technical Field

The present disclosure relates to the field of underwater lighting for pools and spas. More specifically, the present disclosure relates to an underwater light having a sealed polymer housing, and a method of manufacture therefor.

Related Art

In the underwater lighting field, submersible luminaires are known and commonly used. These devices are conventionally made from a combination of metal, plastic, and glass. Furthermore, the various electrical components within luminaires require adequate heat dissipation through the use of heat sinks. The heat sinks draw heat away from the electrical components and dissipate it, thereby preventing any damage to the electrical components or luminaire. Metal components are often utilized as heat sinks due to their high thermal conductivity compared to plastics, glass, and other materials. However, metal heat sinks are also electrically conductive.

In submersible luminaires, the exposed metal portions of the luminaire, as well as components external to the luminaire housing (e.g., the luminair cord and a niche), require safe electrical grounding. This requires significant design efforts and expense to assure the safety of the device. Indeed, a critical interface must be provided between the metal components of the luminaire and the niche into which the luminaire is installed, to allow for adequate grounding. Such an interface facilitates the safe grounding and bonding of the metal components. Due to the complexity of such interfaces and the necessity for a luminaire and niche to create a safe interface, Underwriter's Laboratories has required that luminaires and niches be from the same manufacturer. As a result of the foregoing, it would be desirable to provide a submersible luminaire housing constructed of a material which is thermally conductive yet electrically insulative.

Thermally conductive and electrically insulative polymer materials are known. These materials allow for the dissipation of heat while restricting the conduction of electricity therethrough, making them ideal for a situation in which thermal energy must be transferred yet electrical energy must be insulated.

SUMMARY

The present disclosure relates to an underwater light having a sealed polymer housing. The light includes a rear housing component formed at least in part from a thermally conductive and electrically insulative material; an electronic assembly having at least one light-emitting element mounted thereto, the electronic assembly in thermal communication with the rear housing component; and a lens mounted to the rear housing component and forming a watertight seal therebetween, the lens and the rear housing component enclosing the electronic assembly, wherein at least a portion of the rear housing component conducts heat away from the electronic assembly to cool the electronic assembly. Heat-radiating structures are provided on the rear housing component for dissipating heat conducted by the rear housing component. The electronic assembly could be mounted to the rear component by a thermally conductive adhesive. A latch could be provided on the rear housing component or a bezel of the light, and is operable to selectively install or remove the light from an installation location. One or more optical components, such as light culminators, an internal collimator lens, and/or light pipes could be provided for enhanced illumination. An optically-transparent potting compound could be used to encapsulate the at least one light-emitting element and/or the electronic assembly. A cable attachment assembly could also be provided for creating a watertight seal between the rear housing component and the cable, and terminal posts could be included for attaching conductors of the cable to the electronic assembly.

The present disclosure also provides a method of manufacturing an underwater light. The method includes the steps of forming a rear housing component from a thermally conductive and electrically insulative material; forming a lens; attaching an electronic assembly having at least one light mounted thereto to the rear housing component; and attaching the lens to the rear housing component, wherein the electronic assembly is enclosed within the rear housing component and the lens and a watertight seal is formed between the rear housing component and the electronic assembly.

The present disclosure further relates to an underwater light having a watertight housing including a lens and a rear housing component; at least one light-emitting element positioned within the housing; and an impeller for circulating fluid past an exterior surface of the watertight housing to cool the underwater light.

Still further, the present disclosure relates to an underwater light including a watertight housing including a lens and a rear housing component; at least one light-emitting element positioned within the housing; and at least one heat-dissipating structure attached to an exterior surface of the watertight housing.

BRIEF DESCRIPTION OF THE DRAWINGS

The foregoing features of the disclosure will be apparent from the following Detailed Description of the Disclosure, taken in connection with the accompanying drawings, in which.

DETAILED DESCRIPTION

The present disclosure relates to an underwater light having a sealed polymer housing and a method of manufacture, as described in detail below with reference to FIGS. 1-13D.

Figure 1:
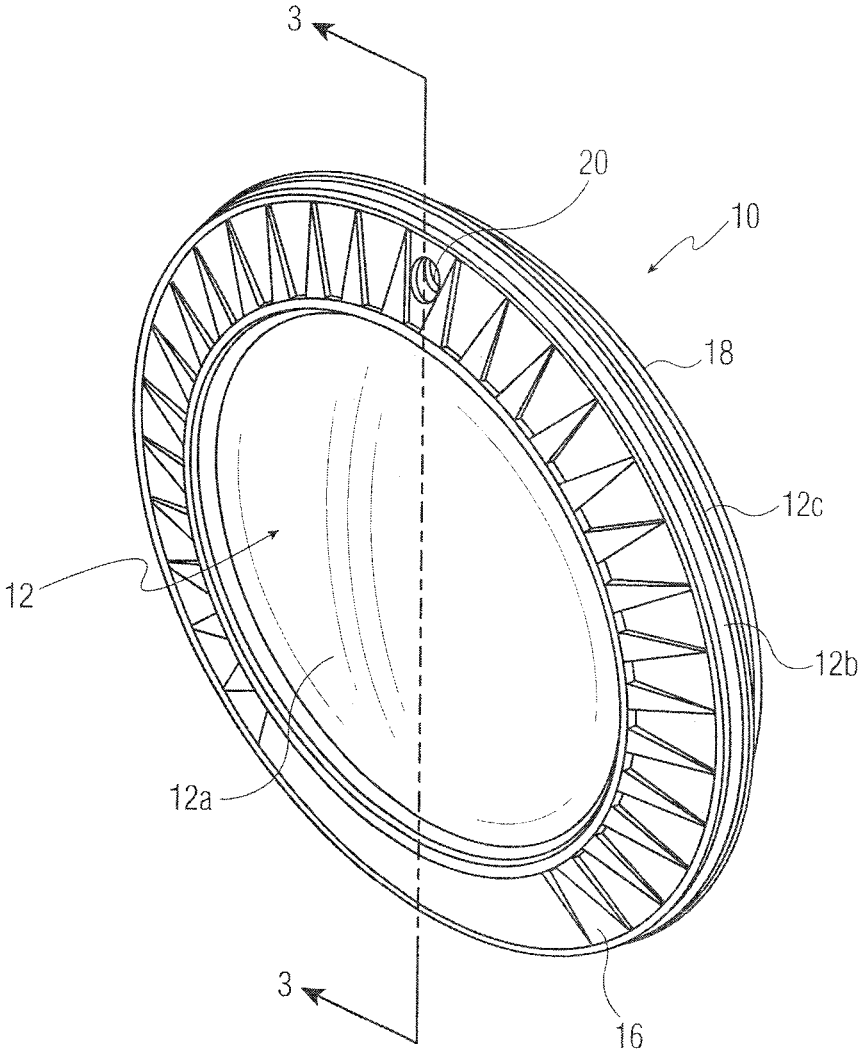
FIG. 1 is a perspective view of the underwater light of the present disclosure.

FIG. 1 is a perspective view showing the underwater light 10 of the present disclosure. The light 10 includes a lens 12 having a central lens portion 12*a* and a peripheral region including a flanged portion 12*b* and annular wall 12*c*. The lens 12 could be formed using any suitable manufacturing process (e.g., injection molding, compression molding, thermoforming, etc.). The term "lens," as used herein, refers not only to an optical component which can focus light (as in a conventional lens), but also components which are merely transparent and do not focus light, such as a transparent and/or translucent cover. The lens 12 could be formed from any suitable, electrically-insulating material, such as glass or a polymeric material (e.g., plastic). The flanged portion 12*b* receives a bezel 16 positioned about the central lens portion 12*a*. The light 10 can be positioned such that an aperture 20 formed in the bezel 16 can be rotated up to 360 degrees from the typical 12 o'clock position of existing underwater lights. This allows the lens 12*a* to be positioned to direct light in a preferred direction in a pool or spa. Also provided is rear housing component 18, which is constructed of a thermally conductive and electrically insulative polymer material. Such a material could include, but is not limited to, the electrically insulative and thermally conductive material manufactured by Cool Polymers, Inc. under the trade name COOLPOLY. Any other material which is electrically insulative and thermally conductive (e.g., plastic) could be utilized for the rear housing component 18 without departing from the spirit or scope of the present disclosure.

Figure 2:
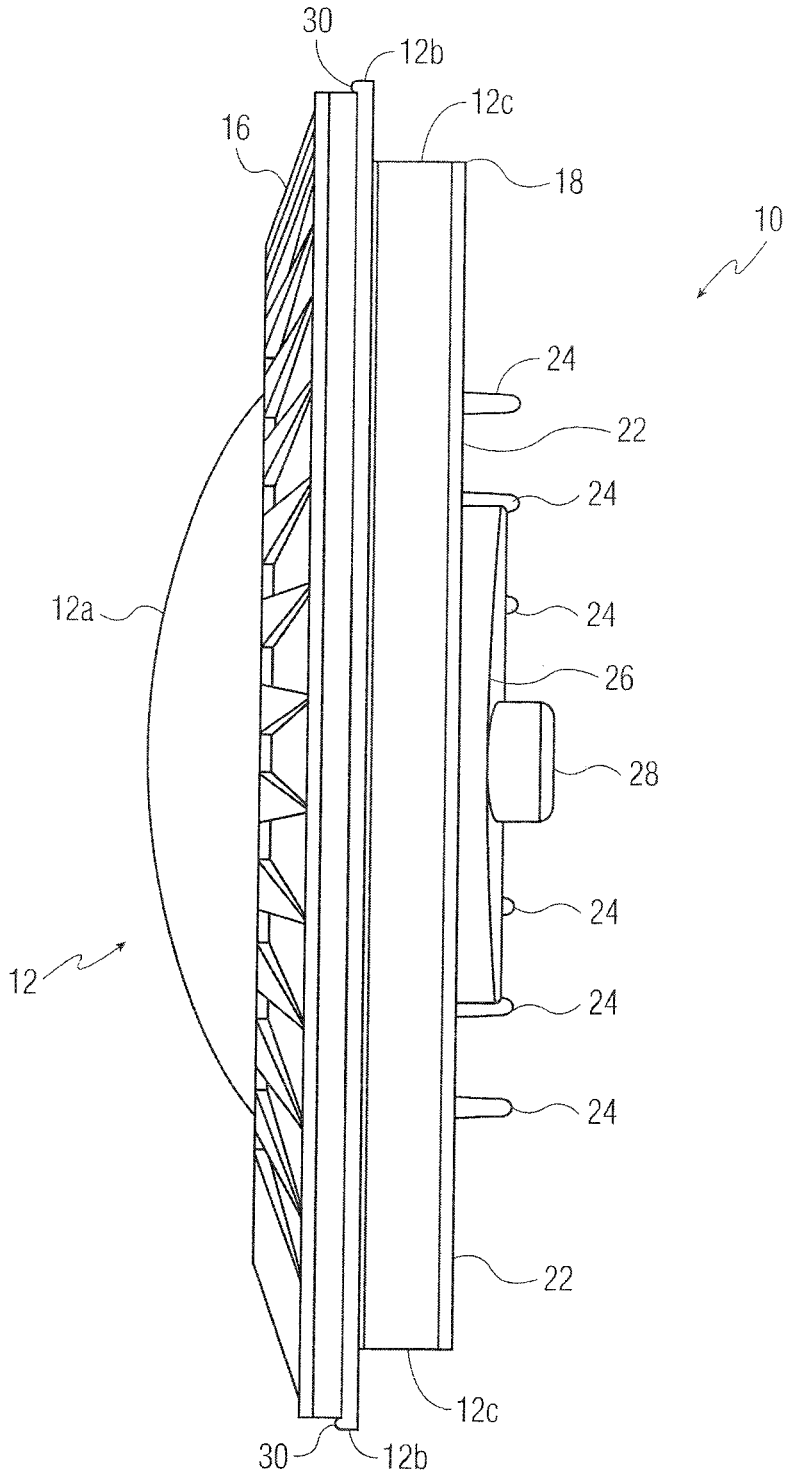
FIG. 2 is a side view showing the light of FIG. 1 in greater detail.

FIG. 2 is a side view showing the underwater light 10 in greater detail. As mentioned above, the lens 12 includes a flanged portion 12*b* which includes an annular projection 30 for constraining the bezel 16. The lens 12 is in watertight communication with the rear housing component 18, e.g., by means of an epoxy, adhesive, and/or frictional fit. The rear housing component 18 is constructed of a thermally conductive and electrically insulative polymer. Lens 12 may be fabricated from an unbreakable transparent plastic which allows for a light curing adhesive to be utilized for bonding the lens 12 to the rear housing component 18. Further, the rear housing component 18 includes a central portion 22, with integrally-formed heat sink components (heat-radiating structures) 24. The heat-radiating structures 24 are similarly constructed from a thermally conductive and electrically insulative material. The presence of heat-radiating structures 24 on the central portion 22 allows for heat to be properly dissipated away from a printed circuit board (PCB) 40 (shown in FIG. 3), thereby cooling the internal electrical components 42 (also shown in FIG. 3). Heat-radiating structures 24 could be molded to rear housing component 18 during its fabrication, or they may be attached through a suitable means (e.g. sonic welding, etc.).

Optionally, a stepped portion 26 may be formed in the rear housing component 18 to provide additional space within the light 10 for accommodating electrical components (e.g., a transformer). A grommet 28 is provided in rear housing component 18, for allowing external power to be supplied to the electrical components of the fixture by way of a power cable (not shown) and/or control/communications cables (not shown), and for creating a watertight seal with such components. Other means for creating a watertight attachment between the light 10 and the cable (such as the cable attachment assembly of the present disclosure, discussed below), could be utilized. Of course, it is noted that the light 10 could be battery powered, thereby obviating the need for a power cable.

Figure 3:
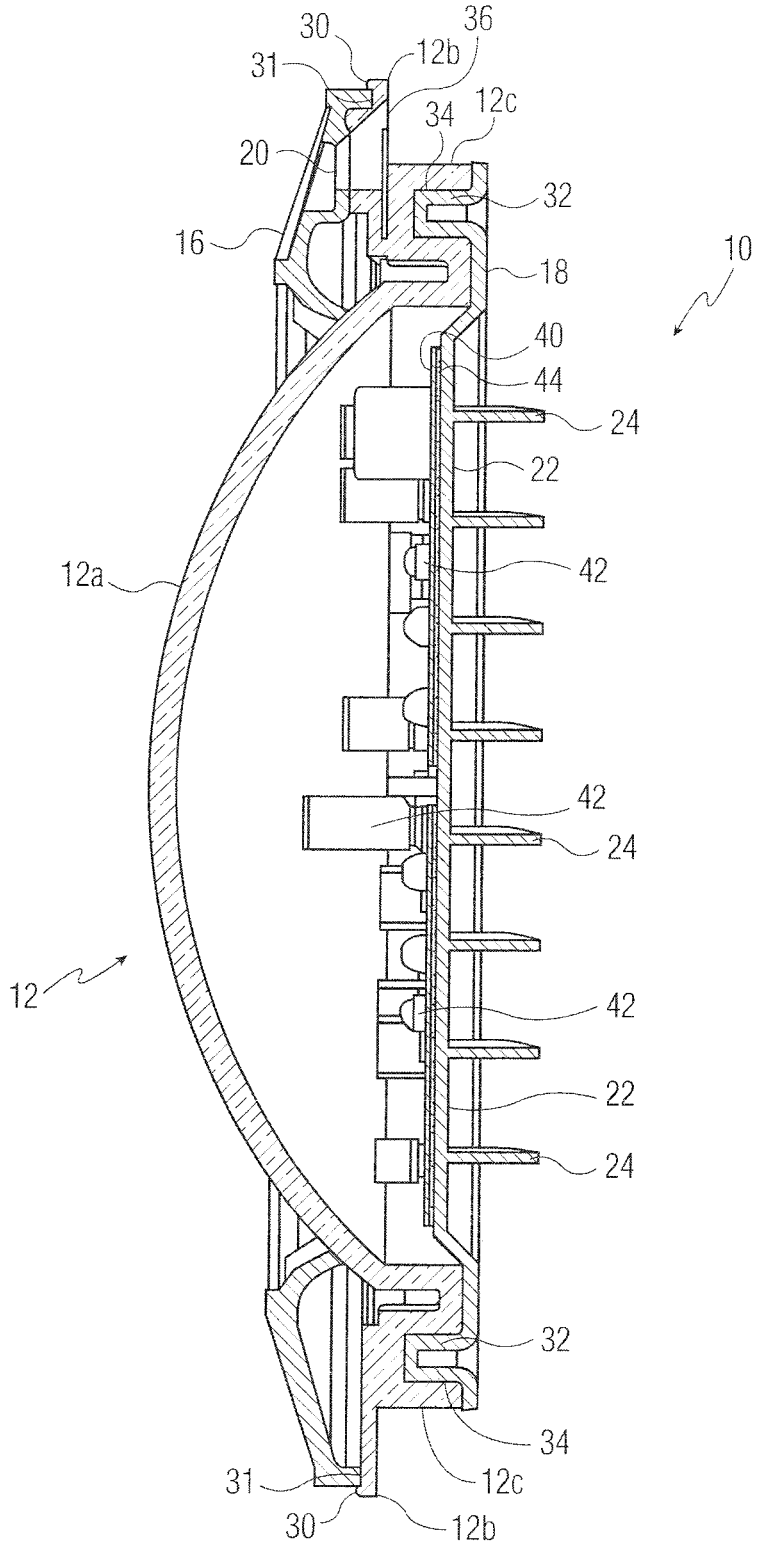
FIG. 3 is a cross-sectional view of the underwater light of the present disclosure, taken along the line 3-3 of FIG. 1.

FIG. 3 is a cross sectional view, taken along dashed line 3-3 of FIG. 1, showing the underwater light 10 in greater detail. Flanged portion 12*b* includes an annular projection 30 and an annular groove 31. The annular groove 31 receives the bezel 16 and constrains lateral movement of the bezel 16. Formed in the bezel 16 is an aperture 20 which allows for the insertion of a tool to install and/or remove the light 10 from a pool or spa. The aperture 20 also allows for the insertion of a screw so that the light 10 could be fastened to a niche or recess of a pool or spa, as is known in the art. As shown in FIGS. 1 and 3, the aperture 20 could be elongate in shape, to receive a screw in various positions to accommodate niches or recesses of a pool or spa of various diameters, thus allowing the light 10 to be installed in multiple locations and without requiring modification of the light 10. Additionally, a plurality of round apertures could be provided, extending outwardly from the center of the light 10 and toward the periphery of the light 10, to accommodate multiple screw positions. Also, the bezel 16 could be sized and shaped so as to cover niches or recesses of pools or spas having different diameters, or it could be oversized so as to cover a plurality of different diameters.

An annular projection 32 is provided on the rear component 18, and is received by an annular recess 34 formed in the lens 12. The annular projection 32 could be bonded with the annular recess 34 through the use of a light curing adhesive, or any other suitable adhesive, to provide a watertight seal for the light 10. Of course, the positions of the annular projection 32 and annular recess 34 could be reversed; that is, the annular projection 32 could be provided on the lens 12, and the annular recess 34 could be provided on the rear component 18. Also, it is noted that the annular projection 32 and annular recess 34 need not be provided to facilitate attachment of the lens 12 to the rear housing component 18. Indeed, these components could be attached to each other by way of corresponding flat annular surfaces which are attached to each other by gluing, bonding, etc., to create a watertight seal. Further, a gasket could be used to create a watertight seal between the lens 12 and the rear housing component 18. Still further, the lens 12 could be attached to the rear housing component 18 by way of a watertight threaded connection, i.e., the lens 12 could be threaded onto the rear housing component 18, and vice versa. Also, the lens 12 could be attached to the rear housing component 18 by way of adhesives, sonic welding, etc. As can be appreciated, the present disclosure provides a permanently sealed luminaire.

Rear housing component 18 further includes an inner surface to which printed circuit board (PCB) 40 is attached. As shown, PCB 40 is enclosed by the lens 12 and the rear housing component 18, and is affixed to the inner surface of rear housing component 18. PCB 40 could be bonded to rear housing component 18 by means of a thermally conductive material 44, such as a thermally-conductive grease, adhesive, or potting compound. A thermally-conductive adhesive includes BOND-PLY 100 thermally-conductive, fiberglass-reinforced, pressure sensitive adhesive tape manufactured by the Bergquist company, or a thermally-conductive, filled polymer composite interface including an adhesive layer, such as that disclosed in U.S. Pat. No. 6,090,484 to Bergerson, the entire disclosure of which is expressly incorporated herein in by reference. The application of thermally conductive material 44 allows for PCB 40 to be in thermal communication with rear housing component 18. This allows for the transfer of heat from the electronic components 42 of PCB 40, through thermally conductive material 44 and central portion 22 of the housing wall 18, and ultimately to the heat-radiating structures 24. As mentioned above, PCB 40 may include several types of electronic components 42 including, but not limited to, light emitting diodes (LED's), transistors, resistors, etc.

The heat-radiating structures 24 could be provided in any desired location and/or orientation. For example, the heat-radiating structures 24 could run vertically along the rear housing component 18. Preferably, the heat-radiating structures 24 are oriented so as to facilitate maximum thermal transfer of heat from the heat-radiating structures 24 to pool water flowing behind the light 10 when it is installed in a pool or spa. Advantageously, the natural flow of such water facilitates cooling of the heat-radiating structures 24 (e.g., cooler pool water near the bottom of the light 10 flows upwardly through the heat-radiating structures 24, absorbing heat from the heat-radiating structures 24, and exiting near the top of the light 10). Also, it is noted that the number and positioning of the heat-radiating structures 24 could correspond to the thermal "profile" of the PCB 40; that is, the heat-radiating structures 24 could be shaped and positioned so that they match the components on the PCB 40 which generate significant amounts of heat (e.g., heat-radiating structures could be provided to match the position and quantity of light-emitting diodes (LEDs) on the PCB 40, and other components on the PCB 40). Still further, the shapes of the heat-radiating structures 24 could be altered as desired—they could be rounded, rod-shaped, elongate, rectangular, etc., or have any other desired shape or size.

Figure 4:
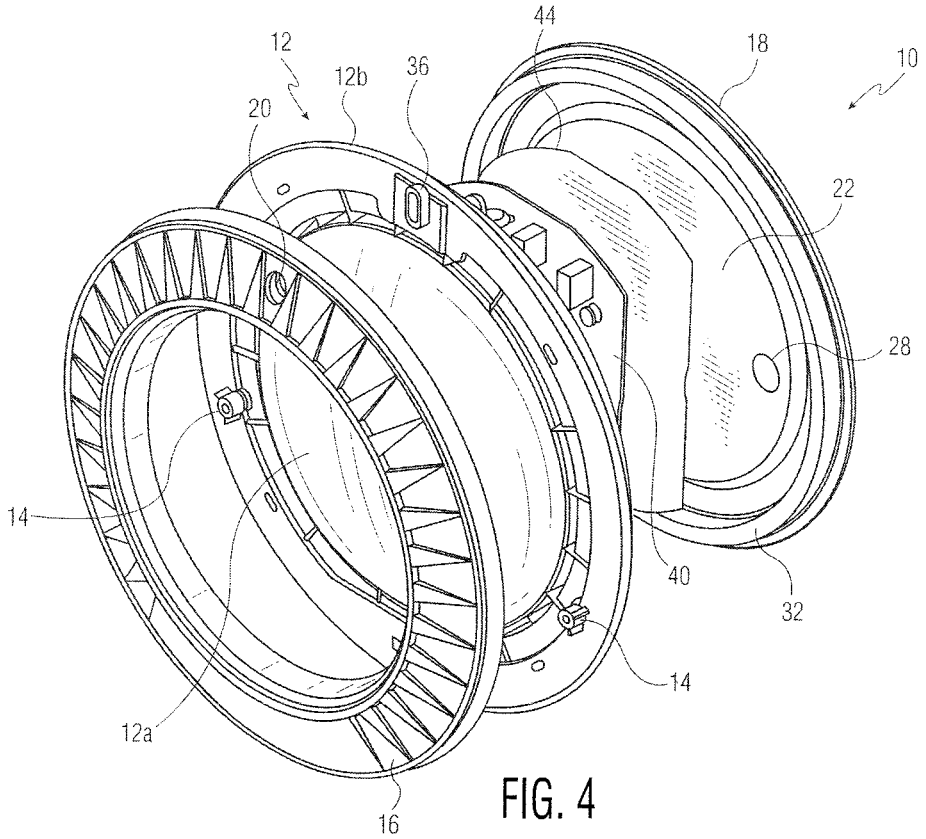
FIG. 4 is an exploded perspective view showing the components of the present disclosure in greater detail.

FIG. 4 is an exploded perspective view showing the components of underwater light 10 in greater detail, and in particular, shows steps for fabricating the light 10. First, rear housing component 18 is manufactured from a thermally conductive polymer, including optional grommet 28, central portion 22, heat-radiating structures 24 (not shown), and annular projection 32. The combination of these components may be manufactured through any suitable process (e.g., injection molding, compression molding, thermoforming, etc.). Then, the thermally conductive adhesive 44 is formed on central portion 22. This allows for PCB 40 to be mounted to central portion 22 and in thermal communication with rear housing component 18. The thermal interface between PCB 40 and central portion 22 may be created through the use of the materials and processes disclosed in co-pending U.S. patent application Ser. No. 12/343,729, the entire disclosure of which is expressly incorporated herein by reference. Such thermal communication allows for heat generated by the electrical components 42 of PCB 40 to be adequately dissipated, thus extending the life of the underwater light and allowing for a permanently sealed luminaire. Further, no exposed, electrically-charged, metallic components exist external to the light 10.

Lens 12, including lens portion 12*a*, flanged portion 12*b*, bezel mounts 14, aperture 36 and annular wall 12*c* (not shown), is then manufactured using any suitable process (e.g., injection molding, compression molding, thermoforming, etc.). Next, the annular projection 32 of the rear component 18 is inserted into, and attached to, the annular recess 34 (not shown) of the lens 12 to enclose PCB 40 within the light 10. A permanent bond could be created between these components. Finally, bezel mounts 14 allow for the attachment of bezel 16 to flanged portion 12*b*. Further, the combination of bezel 16 with flanged portion 12*b* results in the alignment of aperture 20 with aperture 36. Alignment of these apertures creates an orifice penetrating both bezel 16 and flanged portion 12*b* of the lens 12, allowing for the insertion of a tool to install and/or remove underwater lighting underwater light 10.

Figure 5:
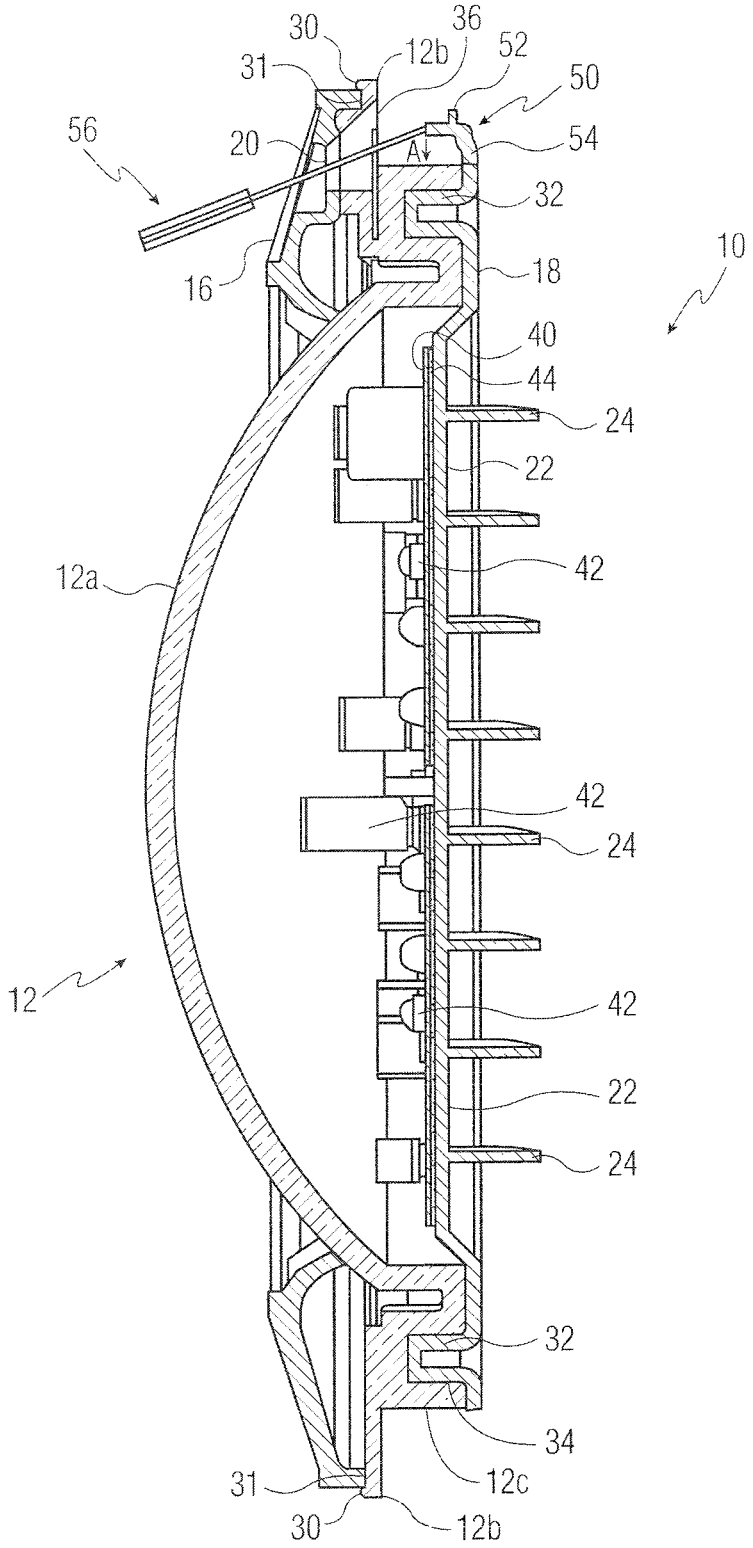
FIG. 5 is a cross-sectional view of the present disclosure, showing an optional latch provided on the rear housing component.

FIG. 5 is a cross-sectional view of the light 10 of the present disclosure, showing an optional latch 50. Latch 50 includes a living hinge 54 and projection 52. The latch 50 projects from the rear housing component 18. When the light 10 is placed into a niche or recess of a pool or spa, hinge 54 of latch 50 flexes toward the annular wall 12*c* to allow for insertion of the light into the niche or recess, and then returns to its original position so as to lock projection 52 into place within a groove formed within the niche or recess. This allows for the light 10 to be locked in place within the niche or recess. Further, latch 50 is aligned with aperture 20 and aperture 36 to allow for the insertion of removal tool 56 which, when inserted, flexes latch 50 in the direction of arrow A to disengage the projection 52 and to allow for the removal of underwater lighting underwater light 10 from the niche.

It is noted that the lens 12 need not include a peripheral flange, i.e., the flanged portion 12*b* and annular wall 12*c* need not be provided. In such circumstances, the lens 12 could be shaped as a conventional lens for an underwater pool light, e.g., in the shape of a convex disc, and the lens 12 could be held in watertight position against the rear housing component 18, e.g., by the bezel 16. It is further noted that the bezel disclosed herein could rotate with respect to the other components of the light, e.g., with respect to the lens and/or rear housing component. Also, the light of the present disclosure could include "bayonet" projections on opposite sides of the light (e.g., on opposite sites of the annular wall 12*c*, on opposite sides of the bezel 16, or at any other desired location on the light 10) which are accepted by corresponding recesses in a niche or recess of a pool, so as to facilitate removable installation of the light 10 simply by inserting the bayonet projections into the recesses and rotating the light.

It is also noted that a separate layer (or plate) of thermally conductive material could be positioned between the rear housing component 18 and the PCB 40. Such a separate layer (or plate) could be attached to the rear housing component 18 and the PCB 40 using a thermally-conductive adhesive. Also, the entirety of the rear housing component 18 need not be formed of a thermally-conductive polymeric material. Rather, only a desired portion of the housing wall 18 could be formed from such material, in locations where significant amounts of heat are generated. In such circumstances, the remainder of the rear housing component 18, as well as the bezel 16, could be formed by a non-thermally-conductive polymeric material, and the thermally-conductive portion could be attached to the non-thermally-conductive portion by way of insert molding, overmolding, sonic welding, adhesives, etc.

Advantageously, the electrically non-conductive nature of the exterior components of the light 10 of the present disclosure (i.e., the lens 12, bezel 16, and rear housing component 18) permit the light 10 it be installed in any location in a pool or spa without requiring specific approval of Underwriters Laboratories (UL). Further, since the exterior of the light 10 is electrically non-conductive, no specific bonding or grounding of the light 10 is necessary.

Figure 6:
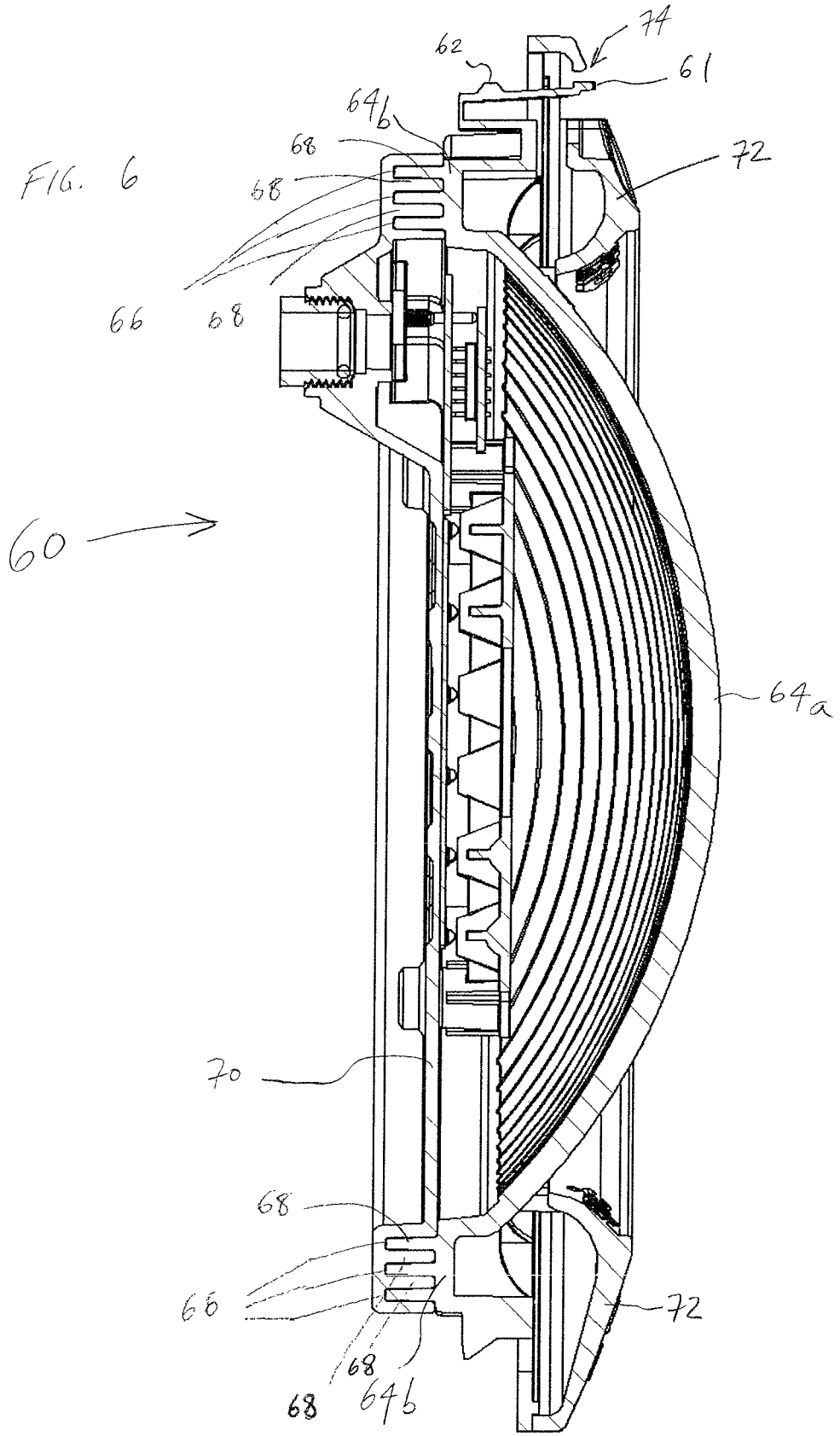
FIG. 6 is a cross-sectional view of another embodiment of the underwater light of the present disclosure, wherein an optional latch is provided on a peripheral region of a lens of the light.

FIG. 6 is a cross-sectional view of another embodiment of the underwater light of the present disclosure, indicated generally at 60. In this embodiment, a latch 61 is attached to, or formed integrally with, a peripheral region 64*b* of the lens 64*a* of the light 60. The latch 61 includes a protrusion 62 which is biased by the latch 61 into position in a peripheral groove formed in recess or niche of a pool (not shown) to retain the light 60 in position within the recess or niche. The latch 61 could be formed of the same material as the lens 64*a* and peripheral region 64*b*, e.g., high-impact, transparent plastic or any other suitable material. A plurality of interstitial, interlocking annular protrusions 66 and 68 are provided for interlocking the lens 64*a* to a rear component 70 of the light. The protrusions 66 and 68 could be epoxied or glued together to form a watertight interface, or a frictional fit between these components could be utilized to provide a watertight interface. It is noted that the interlocking protrusions 66 and 68 could be used in any embodiment of the underwater light of the present disclosure, if desired.

Figure 7:
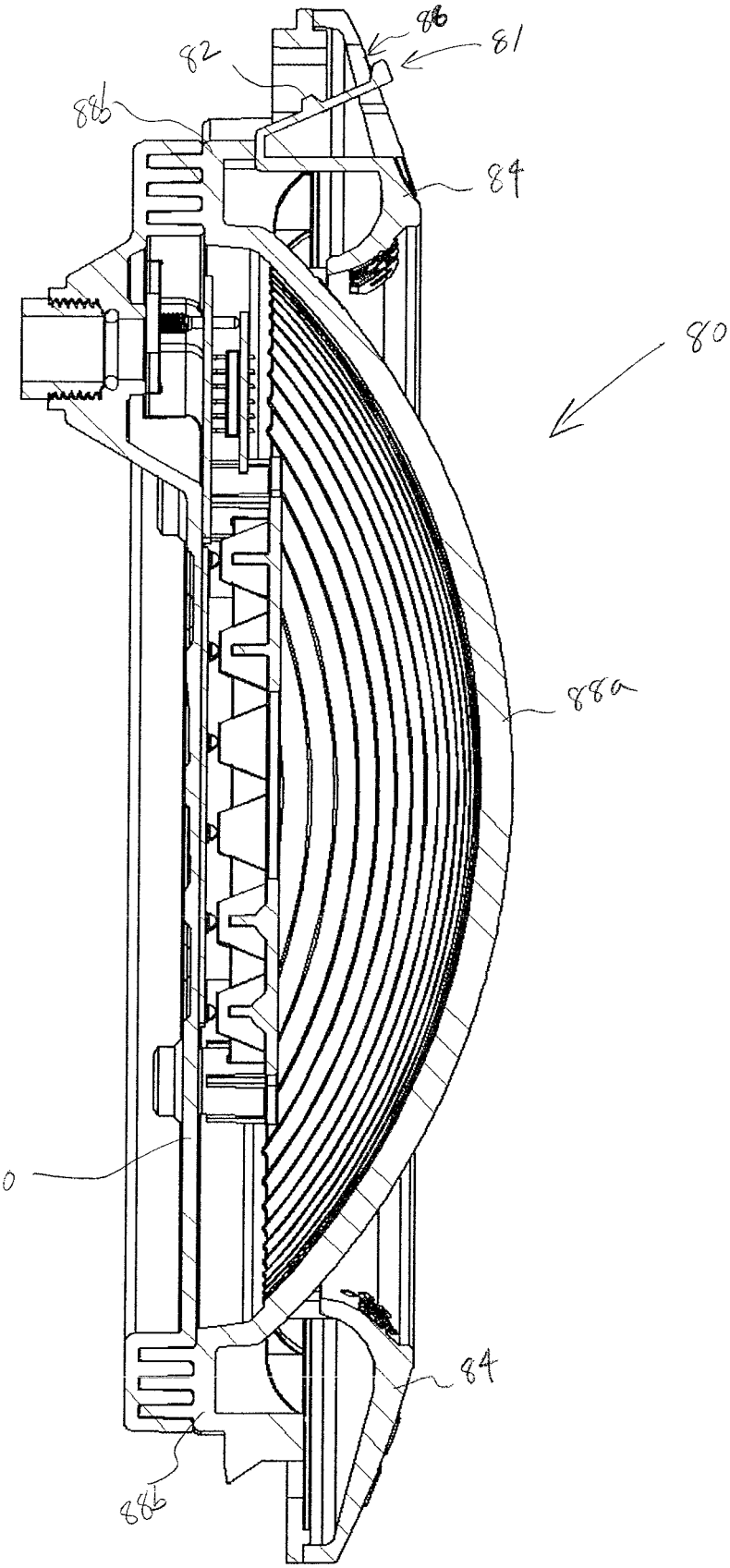
FIG. 7 is a cross-sectional view of another embodiment of the underwater light of the present disclosure, wherein an optional latch is provided on a bezel of the light.

FIG. 7 is a cross-sectional view of another embodiment of the light of the present disclosure, indicated generally at 80. In this embodiment, a latch 81 for releasably retaining the light 80 in a recess or niche of a pool is formed integrally with a bezel 84, and includes a protrusion 82 that is biased within a groove (not shown) of the recess or niche. The latch 81 can be depressed using a tool to release the protrusion 82 from the groove, so that the light can be removed from the niche or recess. A peripheral region 88*b* of the lens 88*a* of the light is captured between the bezel 84 and a rear component 90 of the light. A watertight interface is formed between the peripheral region 88*b* and the rear component 90, e.g., by way of interlocking, interstitial projections such as those described above in connection with FIG. 6.

Figure 8:
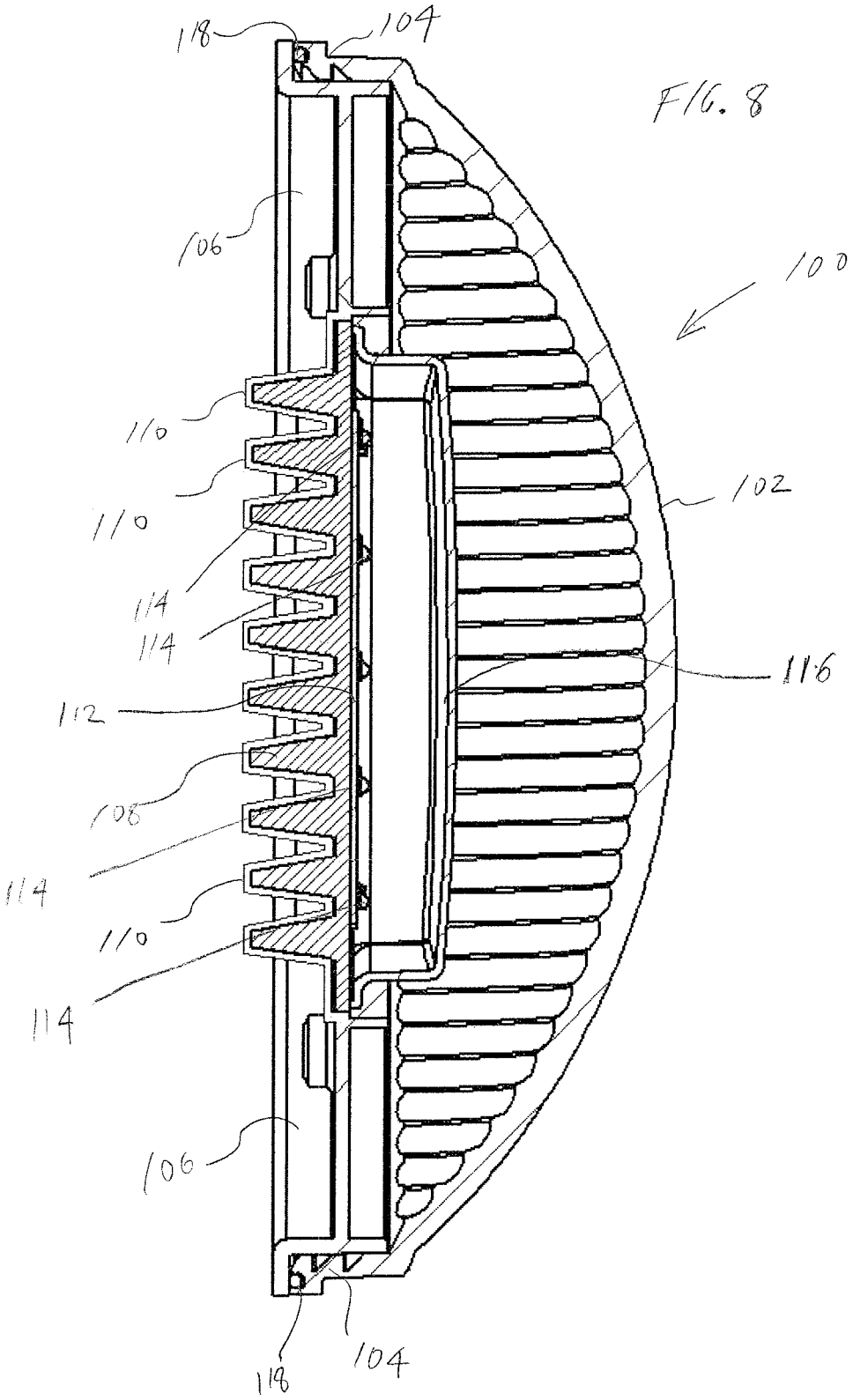
FIG. 8 is a cross-sectional view of another embodiment of the underwater light of the present disclosure, wherein the light includes an internal metal heat sink and an optional internal lens.

FIG. 8 is a cross-sectional view of another embodiment of the light of the present disclosure, indicated generally at 100. In this embodiment, the light 100 includes an internal metal heat sink 108 for dissipating heat generated by one or more lights (e.g., LEDs) or other electrical components mounted to a printed circuit board (PCB) 112. The PCB 112 is in thermal communication with the heat sink 108 using conventional techniques, such as a thermally conductive adhesive, grease, etc. A rear component 106 of the light 100 includes a shaped region 110 that conforms to and contacts the heat-radiating structures of the heat sink 108, so as to permit dissipation of heat from the heat sink 108, through the region 110, and into surrounding water to cool the lights 114 and/or other components mounted to the PCB 112. The region 110, as well as the entire rear component 106, could be formed from a thermally conductive plastic material, and could be over-molded onto the heat sink 108. Further, the region 110 could be coated onto the heat sink 110 and connected (e.g., adhered to) the remainder of the rear component 106. The rear component 106 is attached to a lens 102, and a watertight seal is formed between the two components, e.g., by an O-ring 118 or other suitable means. The rear component 106 and lens 102 form an electrically non-conductive enclosure for the light 100.

An optional internal lens 116 could also be provided between the lights 114 and the lens 102, to direct or focus light generated by the lights 114, as desired. The lens 116 could be a collimator lens for producing parallel beams of light from the light generated by the lights 114, or other desired types of lenses. Also, the collimator lens could be used in conjunction with a spreader lens. Also, it is noted that a bezel (not shown), such as the bezels 72 or 84 of FIGS. 6-7 could be positioned about the periphery of the lens 102. Further, the heat sink 108 could form part of a metal chassis positioned within the light 100, and to which various components within the light are mounted.

Figure 9:
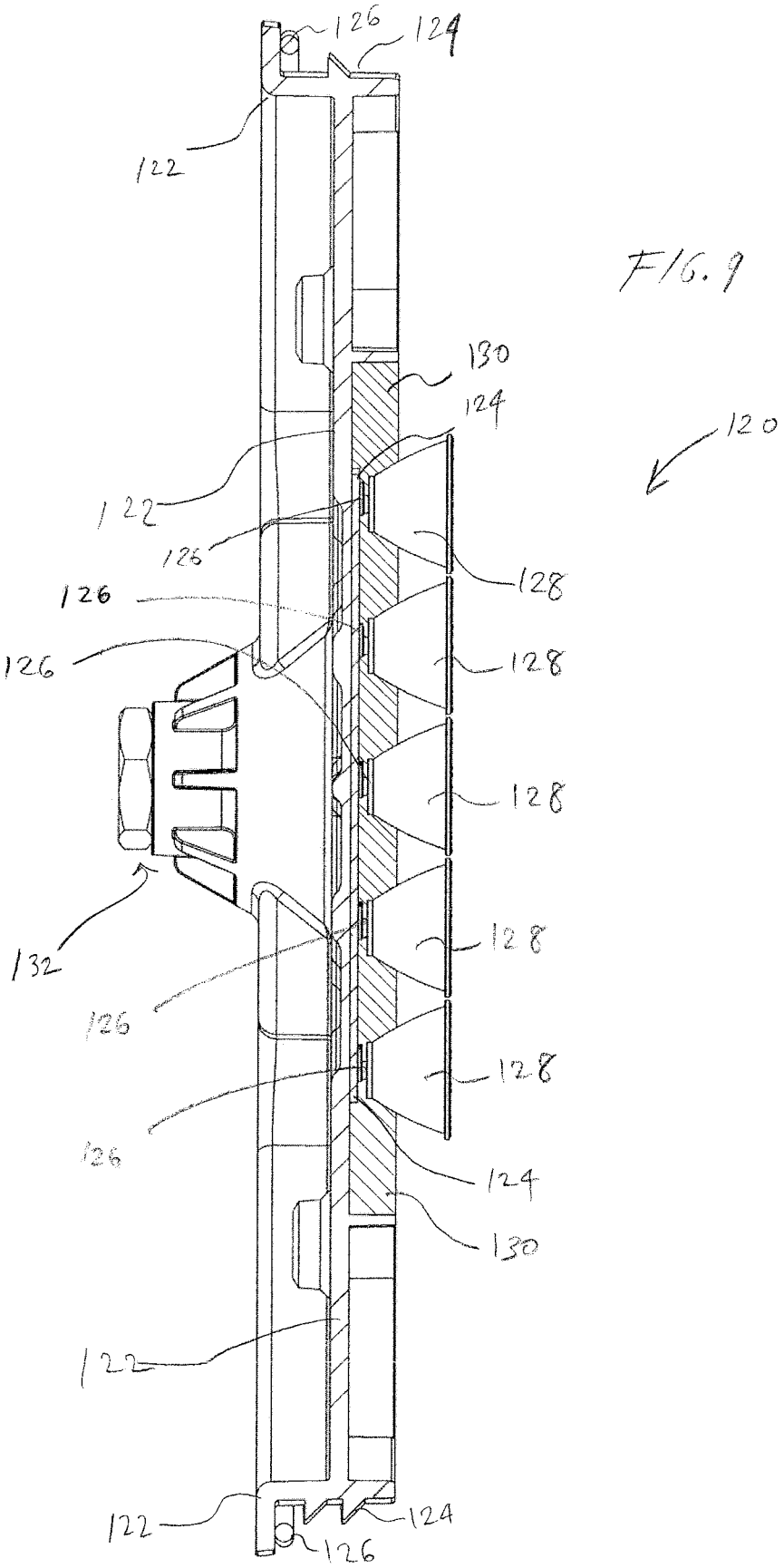
FIG. 9 is a cross-sectional view of another embodiment of the underwater light of the present disclosure, wherein the light includes a plurality of light culminators in optical communication with a plurality of lights on a printed circuit board.

In each embodiment of the underwater light disclosed herein, various optical and/or dielectric components could be used within the light to enhance lighting, and to promote added safety. Such components are entirely optional. For example, as shown in FIG. 9, the light (indicated at 120; the lens and bezel are not shown) could include a plurality of light culminators 128 in optical communication with a plurality of lights (e.g., LEDs) 126. The light culminators 128 collect light generated by the lights 126 to provide high-intensity output. Also, optical light "pipes" could be used in place of the culminators 128, the pipes being made from a solid plastic or glass material and transmitting light from the lights 126 directly to the outer surface(s) of the light 120, e.g., directly to the lens (e.g., lens 102 of FIG. 8) of the light. Also, an optically transparent potting compound 130 could be used to encapsulate the lights 126, as well a PCB 124 to which the lights 126 are mounted and portions of the culminators 128. The potting compound 130 could encapsulate the lights 126 and PCB 124 if the culminators 128 are not provided. The potting compound 130 protects the lights 126 and PCB 124 from exposure to water in the event that the light 120 is no longer watertight, thereby protecting against electrical shock and promoting safety.

The light 120 includes a rear component 122, to which the PCB 124 is mounted. The rear component 122 could be formed from a thermally-conductive and electrtically insulative material, as disclosed herein. A peripheral wall 124 is provided and receives a lens (not shown), such as that shown in FIG. 8. An O-ring 126, or other suitable sealing means, could be provided to ensure a watertight interface between the lens and the rear component 122. A power and/or communications cable (connected to the PCB 124) could enter the light 120 by way of a cable attachment assembly 132, discussed in greater detail below in connection with FIG. 10.

Figure 10:
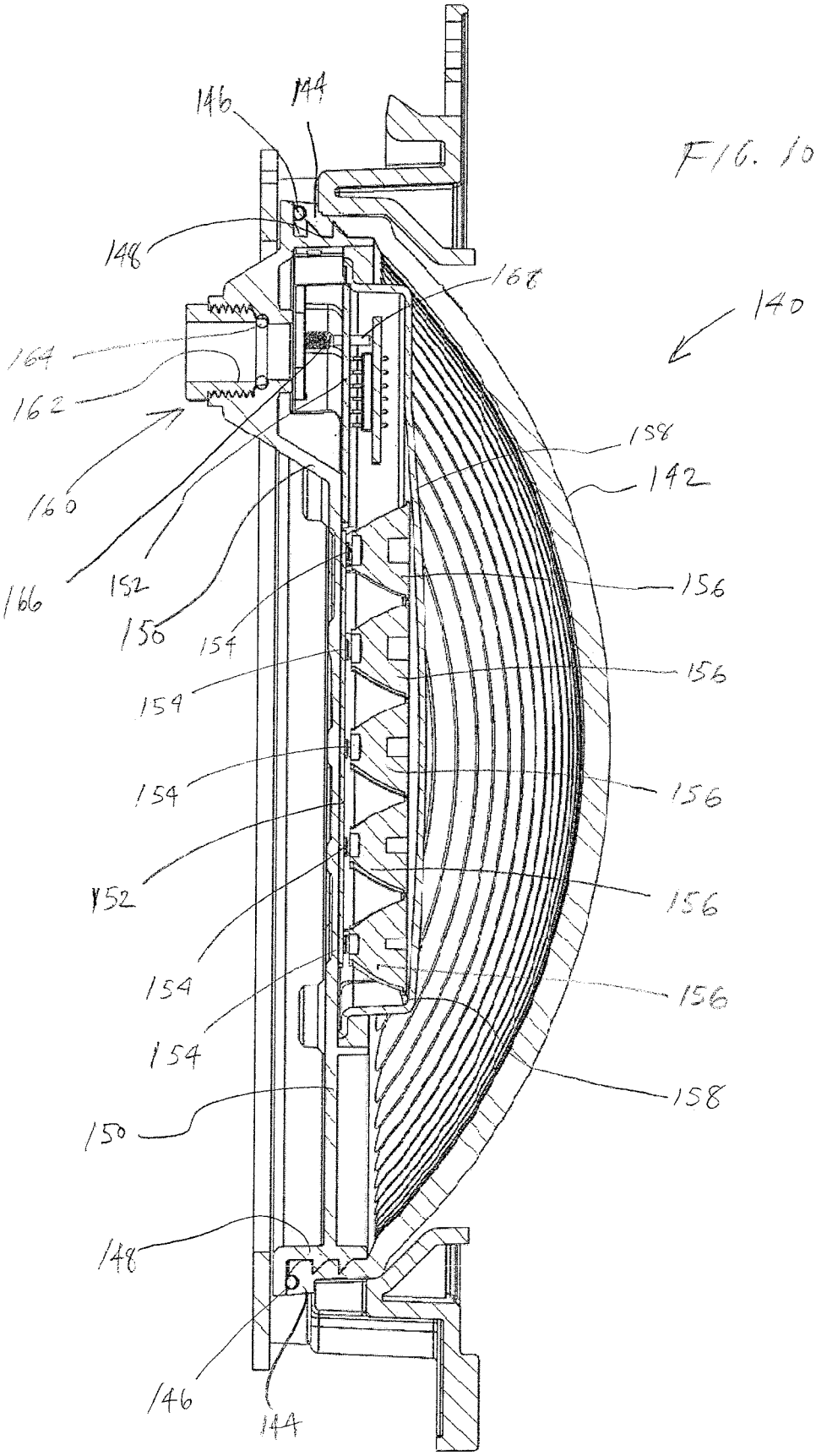
FIG. 10 is a cross-sectional view of another embodiment of the underwater light of the present disclosure, wherein the light includes a plurality of light culminators, an internal lens, and a cable attachment assembly for providing a watertight connection between a power and/or communications cord and the light.

FIG. 10 is a cross-sectional view of another embodiment of the underwater light of the present disclosure, indicated generally at 140, wherein a plurality of light culminators 156, an internal lens 158, and a cable attachment assembly 160 are provided. As mentioned earlier, the light culminators 156 and internal lens 158 focus/intensify light, e.g., light generated by lights 154 mounted on a PCB 152. Outer lens 142 is similar in construction to the lenses disclosed in other embodiments herein, and forms a watertight interface with a peripheral region 148 of the rear component 150 of the light 140, e.g., by way of O-ring 146 or other sealing means. As in other embodiments of the present disclosure, the rear component 150 (or portions thereof) could be formed from a thermally-conductive and electrically insulative polymeric material, and the PCB 152 could be mounted to, and in thermal communication with, the rear component 150 by way of a thermally-conductive adhesive. Of course, the bezel of the present disclosure could also be included, as shown in FIG. 10.

The cable attachment assembly 160 includes a removable, threaded bushing 162 which receives, in watertight communication (e.g., by epoxy, gluing, etc.), an electrical power and/or communications cable. The threaded bushing 162 is threaded into a threaded aperture formed in the rear component 150, and forms a watertight seal with the rear component 150 by way of an O-ring 164 or other sealing means. Each conductor in the cable is attached to a terminal post 166 (e.g., by crimping, soldering, etc.) which includes a projection 168 that extends through an aperture formed in the PCB 152. Each projection 168 of each terminal post 166 could be soldered to one or more conductor traces of the PCB 152, thereby completing electrical connection of the cable to the PCB 152. Also, the projection 168, as well as the terminal post 166, could be encapsulated with a potting compound. The cable attachment assembly 160 could be used in each embodiment of the present disclosure.

Figure 11:
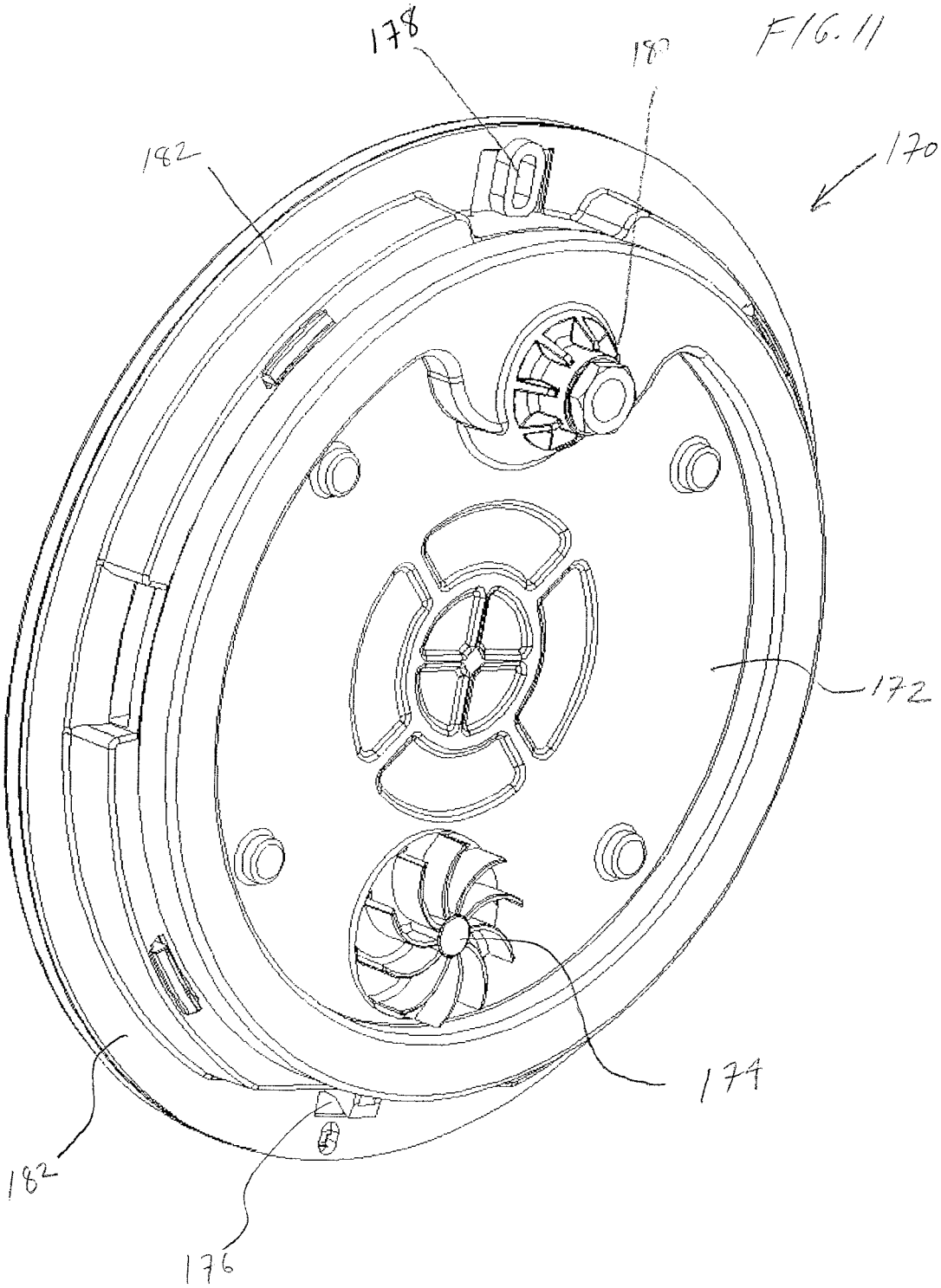
FIG. 11 is a rear perspective view of another embodiment of the underwater light of the present disclosure, wherein the light includes a fluid impeller for cooling the light.

FIG. 11 is a rear perspective view of another embodiment of the underwater light of the present disclosure, indicated generally at 170. In this embodiment, a motor-driven, fluid impeller 174 is provided for circulating water behind the light 170, so as to cool the light during operation thereof. One or more fluid intake ports (not shown) could be provided on the light 170 and in fluid communication with the impeller 174, so as to provide cooler water to the impeller to be circulated behind the light 170. The light 170 includes a bezel 182 and a latch 176 and/or screw-receiving slot 178 for mounting the light 170 to a niche or recess of a pool, as in other embodiments of the light disclosed herein. The impeller 174 is shown installed on the rear component 172 of the light (which could include one or more heat-radiating structures, not shown), but could also be installed at any other desired location of the light 170.

Figure 12:
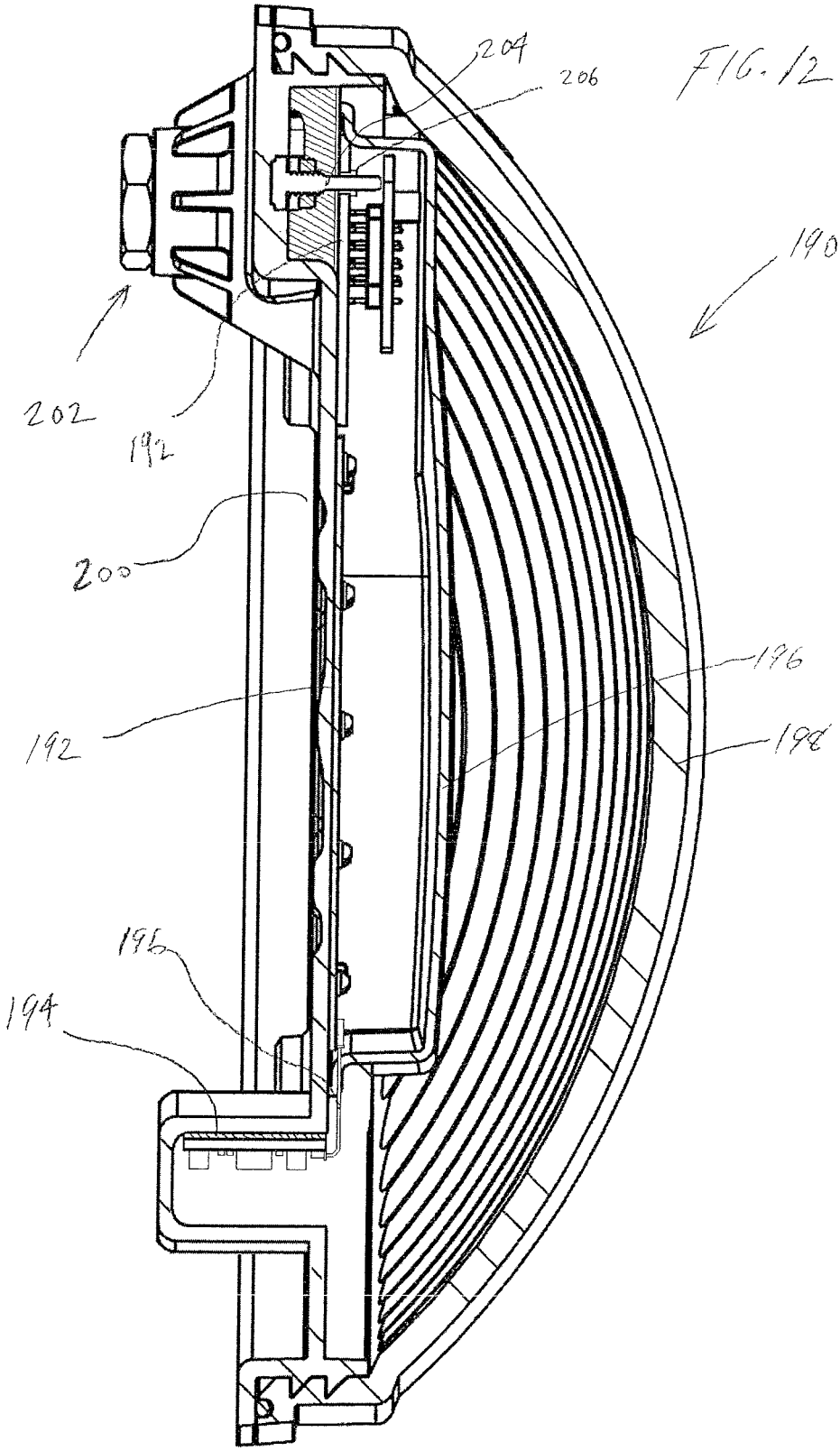
FIG. 12 is a cross-sectional view of another embodiment of the underwater light of the present disclosure, wherein two printed circuit board assemblies are provided within the light.

FIG. 12 is a cross-sectional view of another embodiment of the underwater light of the present disclosure, indicated generally at 190, wherein a plurality of PCBs 192 and 194 are provided. The PCBs 192 and 194 are in electrical communication with each other, and could be in thermal communication with the rear component 200 of the light 190 using thermally-conductive adhesive, etc. By providing two or more PCBs, enhanced thermal management can be provided. That is, by placing components which generate more heat on a separate PCB (and other, less heat-generating components on another PCB), such PCB could be positioned in a location to maximize heat dissipation. As shown in FIG. 12, a lens 198, internal lens 196, and cable attachment assembly 202 (as discussed hereinabove in connection with FIG. 10) could also be provided, as in other embodiments of the present disclosure.

Figure 13A:
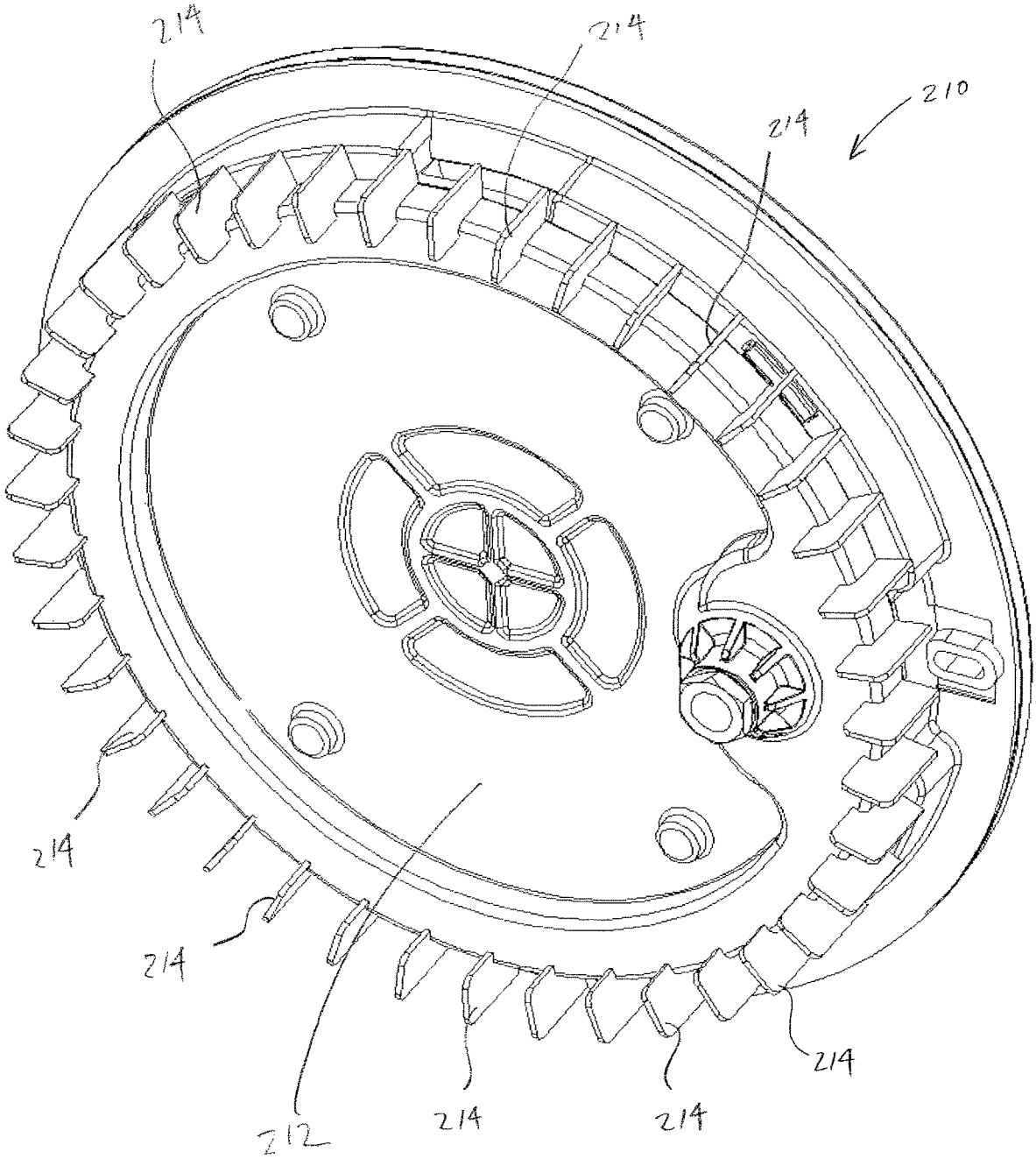
FIGS. 13A-13D are perspective and side views of additional embodiments of the underwater light of the present disclosure, wherein various heat sink fin geometries and positions are provided on the exterior of the light.
Figure 13B:
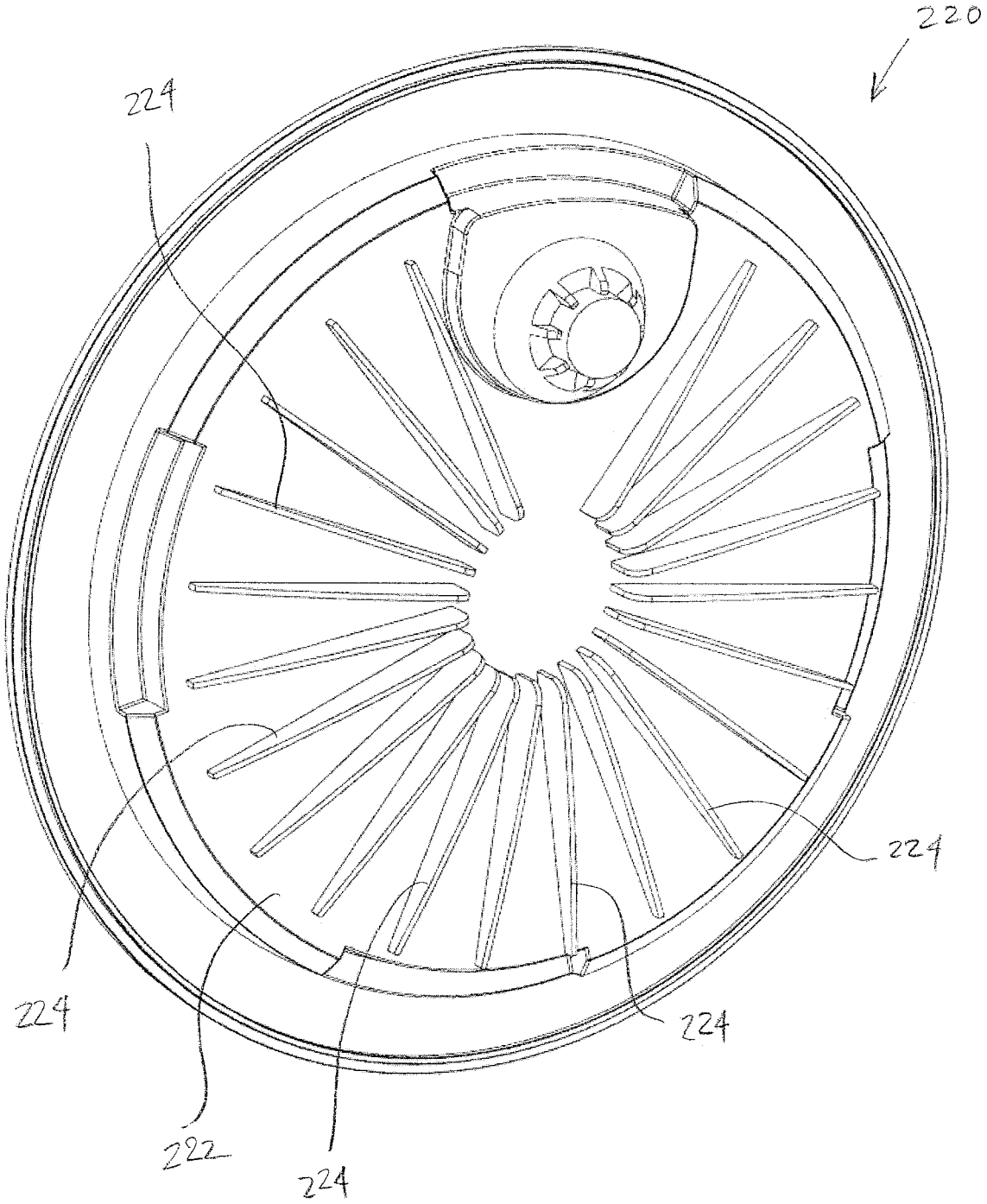
Figure 13C:
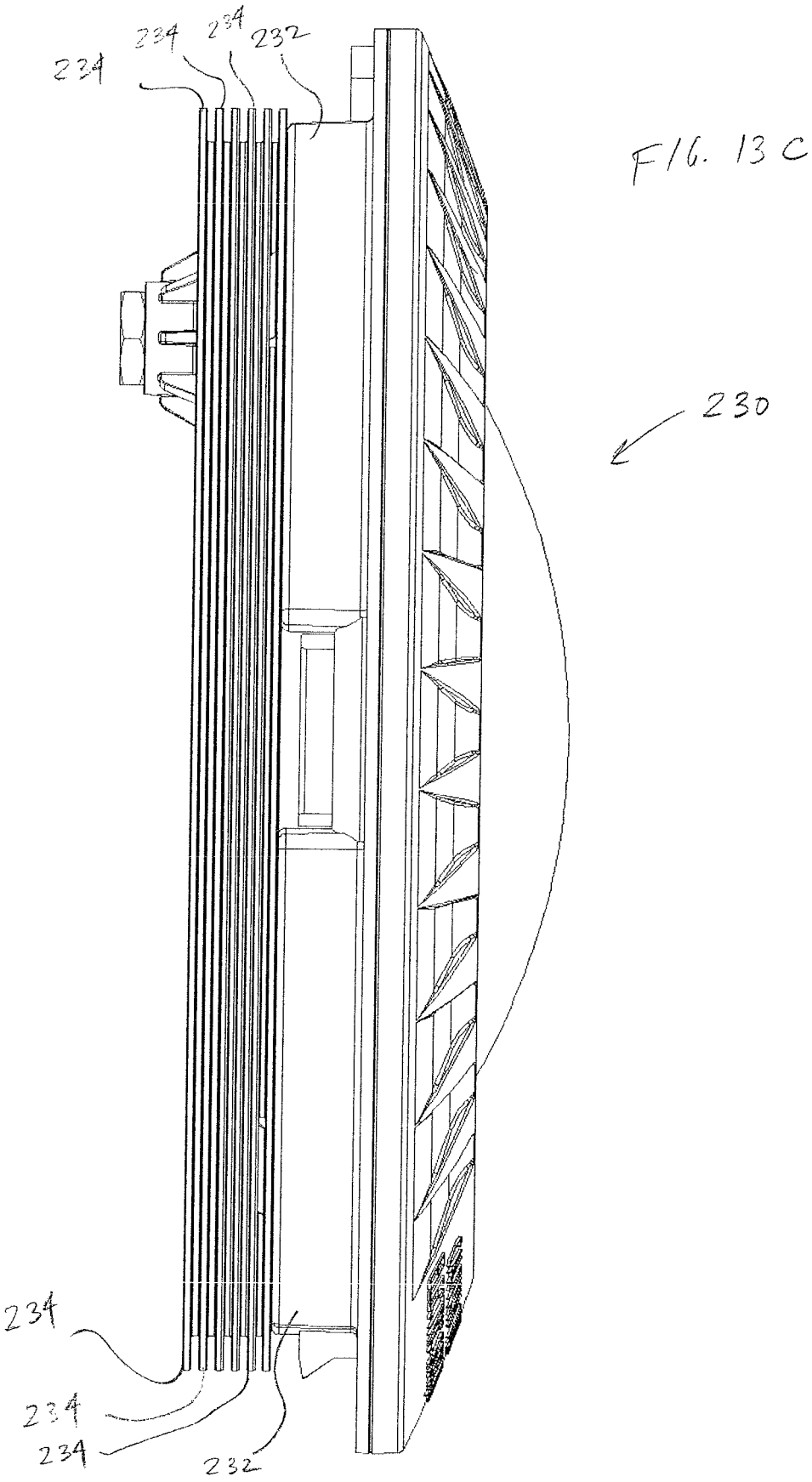
Figure 13D:
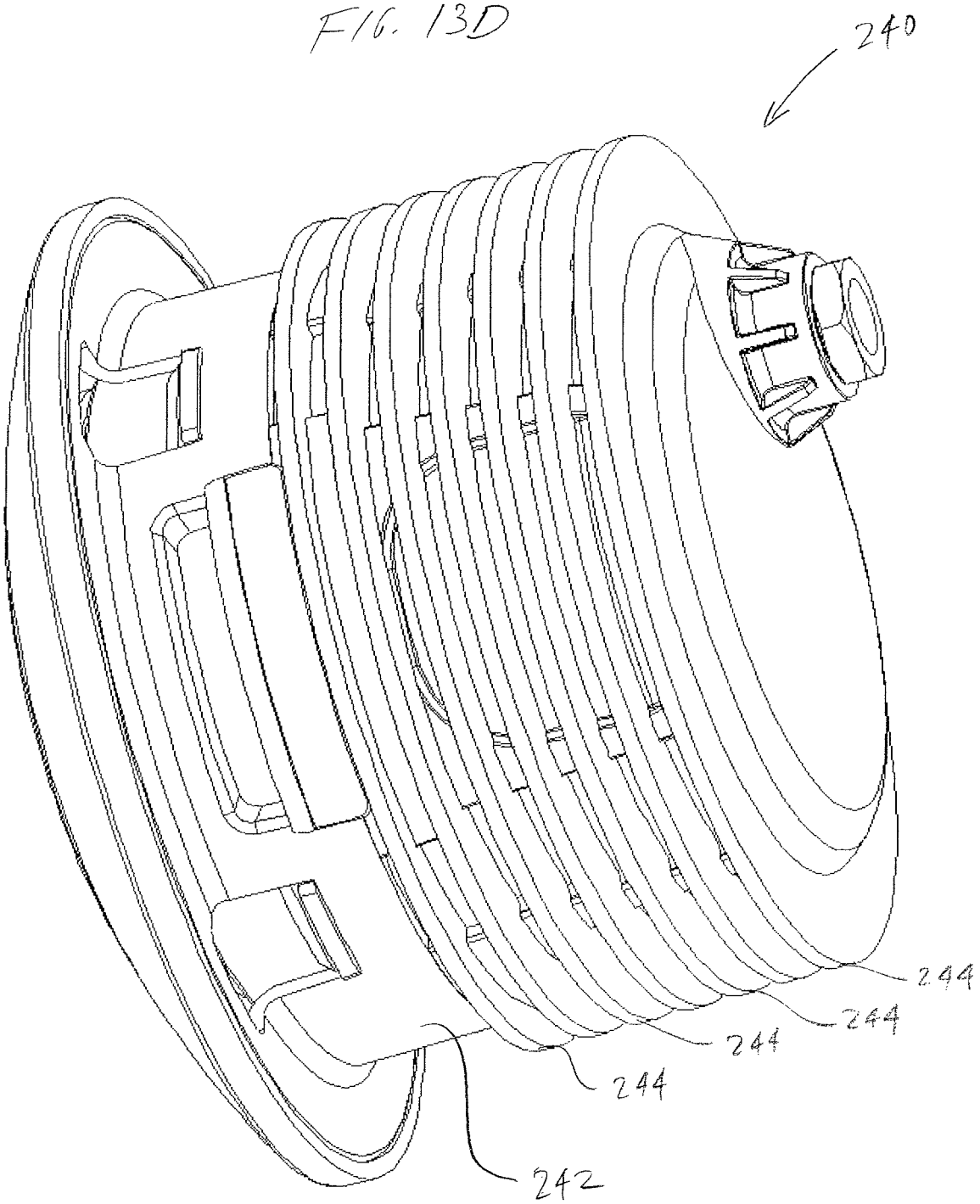

As mentioned earlier, the heat-radiating structures of the present disclosure (forming part of the wall(s) of the light) could be provided in any desired geometry, and at any desired location on the underwater light. Advantageously, they could be positioned so as to maximize fluid flow toward a specific region of the light where the most heat is generated. Examples of such geometries and locations are shown in FIGS. 13A-13D. For example, in the light 210 shown in FIG. 13A, a plurality of radially-arranged heat-radiating structures 214 could be provided about the outer periphery of the rear component 212 of the light 210. Further, in the light 220 shown in FIG. 13B, radially-arranged heat-radiating structures 224 extending from a central region could be provided on the rear component 222 of the light. Moreover, as shown in FIG. 13C, the light 230 could include a plurality of annular heat-radiating structures 234 extending about the sides 232 of the light 230. Further, for lights having a more elongate profile, such as the light 240 shown in FIG. 13D (which could be a light having a single, incandescent and/or halogen light), annular heat-radiating structures 244 could also be provided along the circumference of the sides 242 of the light 240. As can be appreciated, the heat-radiating structures disclosed herein allow for cooling of an underwater light using pool/spa water present in a recess or niche of a pool/spa in which the light is installed.

Having thus described the present disclosure in detail, it is to be understood that the foregoing description is not intended to limit the spirit or scope thereof. What is desired to be protected is set forth in the following claims.

What is claimed is:

1. An underwater light, comprising:

a watertight housing including a lens and a rear housing component, the rear housing component being formed at least in part of a polymeric material that is both thermally conductive and electrically insulative and including a rear wall having an inner surface that includes one of an annular recess or an annular projection extending about a periphery thereof, the lens including the other of the annular recess or the annular projection extending about a periphery thereof, the lens being mounted to the rear housing component and forming a watertight seal therebetween;

a circuit board assembly having a front surface and a rear surface, the front surface including at least one light-emitting element mounted thereto, the circuit board assembly being enclosed by the lens and the rear housing component;

a layer of thermally conductive material positioned between and in contact with the rear surface of the circuit board assembly and the inner surface of the rear wall; and a plurality of polymeric, heat-dissipating structures formed integrally with an exterior surface of the rear housing component;

wherein the annular recess and the annular projection surround the circuit board assembly, the annular recess receiving the annular projection to form the water tight seal between the rear housing component and the lens, wherein said layer transfers heat from said circuit board assembly to said rear housing component, said rear housing component dissipating the heat from the underwater light through at least the heat-dissipating structures.

2. The underwater light of claim 1, wherein the plurality of heat-dissipating structures extend vertically along the exterior surface of the rear housing component.

3. The underwater light of claim 2, wherein water flows upwardly past the plurality of heat-dissipating structures to cool the underwater light.

4. The underwater light of claim 1, wherein the plurality of heat-dissipating structures comprise a fin.

5. The underwater light of claim 1, wherein the plurality of heat-dissipating structures comprise a rod.

6. The underwater light of claim 1, further comprising a flexible latch including a living hinge for releasably securing the light in a niche or a recess of a pool or a spa.

7. The underwater light of claim 1, wherein the plurality of heat-dissipating structures are positioned radially on the exterior surface of the rear housing component.

8. The underwater light of claim 1, wherein the plurality of heat-dissipating structures are annular in shape and extend along a circumference of the light.

9. An underwater light, comprising:

a watertight housing including a lens and a rear housing component, the rear housing component being formed at least in part of a polymeric material that is both thermally conductive and electrically insulative and including a rear wall having an inner surface that includes one of an annular recess or an annular projection extending about a periphery thereof, the lens including the other of the annular recess or the annular projection extending about a periphery thereof, the lens being mounted to the rear housing component and forming a watertight seal therebetween;

a circuit board assembly having a front surface and a rear surface, the front surface including at least one light-emitting element mounted thereto, the circuit board assembly being enclosed by the lens and the rear housing component;

a layer of thermally conductive material positioned between and in contact with the rear surface of the circuit board assembly and the inner surface of the rear wall; and a plurality of polymeric, heat-dissipating structures attached to an exterior surface of the rear housing component;

wherein the annular recess and the annular projection surround the circuit board assembly, the annular recess receiving the annular projection to form the water tight seal between the rear housing component and the lens, wherein said layer transfers heat from said circuit board assembly to said rear housing component, said rear housing component dissipating the heat from the underwater light through at least the heat-dissipating structures.

10. The underwater light of claim 9, wherein the plurality of heat-dissipating structures extend vertically along the exterior surface of the rear housing component.

11. The underwater light of claim 10, wherein water flows upwardly past the plurality of heat-dissipating structures to cool the underwater light.

12. The underwater light of claim 9, wherein the plurality of heat-dissipating structures comprise a fin.

13. The underwater light of claim 9, wherein the plurality of heat-dissipating structures comprise a rod.

14. The underwater light of claim 9, further comprising a flexible latch including a living hinge for releasably securing the light in a niche or a recess of a pool or a spa.

15. The underwater light of claim 9, wherein the plurality of heat-dissipating structures are positioned radially on the exterior surface of the rear housing component.

16. The underwater light of claim 9, wherein the plurality of heat-dissipating structures are annular in shape and extend along a circumference of the light.

17. An underwater light, comprising:

a watertight housing including a lens and a rear housing component, the rear housing component being formed at least in part of a polymeric material that is both thermally conductive and electrically insulative and including a rear wall having an inner surface that includes one of an annular recess or an annular projection extending about a periphery thereof, at least a portion of the lens engaging and contacting the annular recess or the annular projection of the rear wall and permanently sealed therewith forming a watertight seal therebetween;

a circuit board assembly having a front surface and a rear surface, the front surface including at least one light-emitting element mounted thereto, the circuit board assembly being surrounded by the annular recess or the annular projection and enclosed by the lens and the rear housing component;

a layer of thermally conductive material positioned between and in contact with the rear surface of the circuit board assembly and the inner surface of the rear wall; and a plurality of polymeric, heat-dissipating structures attached to an exterior surface of the rear housing component, wherein said layer transfers heat from said circuit board assembly to said rear housing component, said rear housing component dissipating the heat from the underwater light through at least the heat-dissipating structures.

18. The underwater light of claim 17, wherein the plurality of heat-dissipating structures extend vertically along the exterior surface of the rear housing component.

19. The underwater light of claim 18, wherein water flows upwardly past the plurality of heat-dissipating structures to cool the underwater light.

20. The underwater light of claim 17, wherein the plurality of heat-dissipating structures comprise a fin.

21. The underwater light of claim 17, wherein the plurality of heat-dissipating structures comprise a rod.

22. The underwater light of claim 17, further comprising a flexible latch including a living hinge for releasably securing the light in a niche or a recess of a pool or a spa.

23. The underwater light of claim 17, wherein the plurality of heat-dissipating structures are positioned radially on the exterior surface of the rear housing component.

24. The underwater light of claim 17, wherein the plurality of heat-dissipating structures are annular in shape and extend along a circumference of the light.

25. The underwater light of claim 17, wherein the plurality of polymeric, heat-dissipating structures are formed integrally with the exterior surface of the rear housing component.

* * * * *